US010006255B2

(12) United States Patent
Hughes et al.

(10) Patent No.: US 10,006,255 B2
(45) **Date of Patent: *Jun. 26, 2018**

(54) TAPERED SPLINE CONNECTION FOR DRILL PIPE, CASING, AND TUBING

(71) Applicant: Sunstone Technologies, LLC, Oklahoma City, OK (US)

(72) Inventors: William James Hughes, Highlands Ranch, CO (US); Bryan Lane, Houston, TX (US)

(73) Assignee: Sunstone Technologies, LLC, Oklahoma City, OK (US)

( * ) Notice: Subject to any disclaimer, the term of this patent is extended or adjusted under 35 U.S.C. 154(b) by 91 days.

This patent is subject to a terminal disclaimer.

(21) Appl. No.: 15/356,305

(22) Filed: Nov. 18, 2016

(65) Prior Publication Data

US 2017/0067297 A1 Mar. 9, 2017

Related U.S. Application Data

(63) Continuation of application No. 14/636,592, filed on Mar. 3, 2015, which is a continuation-in-part of application No. 12/695,569, filed on Jan. 28, 2010.

(51) Int. Cl.
*E21B 17/046* (2006.01)
*E21B 17/02* (2006.01)
(Continued)

(52) U.S. Cl.
CPC ..... *E21B 17/046* (2013.01); *E21B 17/028* (2013.01); *E21B 17/04* (2013.01); *E21B 17/042* (2013.01); *Y10T 137/0447* (2015.04)

(58) Field of Classification Search
CPC .... E21B 17/042; E21B 17/046; E21B 17/028; E21B 17/04
(Continued)

(56) References Cited

U.S. PATENT DOCUMENTS 1,154,775 A 7/1925 Journeay
1,781,091 A 11/1930 Wilson
(Continued)

FOREIGN PATENT DOCUMENTS

CA 2729230 1/2016
CN 1458384 11/2003
(Continued)

OTHER PUBLICATIONS

"Drill Faster, Farther, Deeper," Aluminum Drill Pipe Inc., Aug. 2009, 11 pages.
(Continued)

*Primary Examiner* — James M Hewitt, II
(74) *Attorney, Agent, or Firm* — Lewis Brisbois Bisgaard & Smith LLP; Craig W. Mueller

(57) ABSTRACT

An apparatus comprises a first number of splines located near a first end of a first joint section and a second number of splines located near a second end of a second joint section. The first number of splines extends in an axial direction of the first joint section and spans a circumferential surface of the first joint section. Each of the first number of splines has a base, a tip, and a pair of flanks that extends from the base to the tip and forms an acute angle. Each of the first number of splines are configured to be received between adjacent pairs of splines in the second number of splines as the first end of the first joint section and the second end of the second joint section are joined.

16 Claims, 15 Drawing Sheets

(51) Int. Cl.
*E21B 17/042* (2006.01)
*E21B 17/04* (2006.01)

(58) Field of Classification Search
USPC ..... 285/913
See application file for complete search history.

(56) References Cited

U.S. PATENT DOCUMENTS

| | | | |
|---|---|---|---|
| 2,000,716 | A | 5/1935 | Polk |
| 2,089,168 | A | 8/1937 | Brown |
| 2,296,198 | A | 9/1942 | Boynton |
| 2,314,897 | A | 3/1943 | Purinton |
| 2,750,569 | A | 6/1956 | Moon |
| 3,126,214 | A | 3/1964 | Wong |
| 3,249,377 | A | 5/1966 | Weasler |
| 3,463,228 | A | 8/1969 | Hearn |
| 3,667,784 | A | 6/1972 | Hokanson et al. |
| 3,689,113 | A | 9/1972 | Blaschke |
| 3,863,959 | A | 2/1975 | Blaschke |
| 4,099,745 | A | 7/1978 | Cobbs |
| 4,240,652 | A | 12/1980 | Wong et al. |
| 4,375,310 | A | 3/1983 | Robinson et al. |
| 4,512,596 | A | 4/1985 | Obrecht |
| 4,683,944 | A | 8/1987 | Curlett |
| 4,792,320 | A | 12/1988 | Nickel |
| 4,862,976 | A | 9/1989 | Meek |
| 5,048,871 | A | 9/1991 | Pfeiffer et al. |
| 5,131,692 | A | 7/1992 | Lemons |
| 5,238,073 | A | 8/1993 | Rear |
| 5,269,572 | A | 12/1993 | Mefferd |
| 5,474,334 | A | 12/1995 | Eppink |
| 5,609,440 | A | 3/1997 | Roche |
| 5,685,381 | A | 11/1997 | Kloppers et al. |
| 5,829,797 | A | 11/1998 | Yamamoto et al. |
| 5,950,744 | A | 9/1999 | Hughes |
| 6,123,561 | A | 9/2000 | Turner et al. |
| 6,148,935 | A | 11/2000 | Wentworth et al. |
| 6,484,801 | B2 | 11/2002 | Brewer et al. |
| 6,543,554 | B2 | 4/2003 | Smith |
| 6,547,479 | B2 | 4/2003 | Dowling, Jr. et al. |
| 6,572,152 | B2 | 6/2003 | Dopf et al. |
| 6,581,980 | B1 | 6/2003 | DeLange et al. |
| 6,634,427 | B1 | 10/2003 | Turner et al. |
| 6,666,274 | B2 | 12/2003 | Hughes |
| 6,761,574 | B1 | 7/2004 | Song et al. |
| 7,104,345 | B2 | 9/2006 | Eppink |
| 7,226,090 | B2 | 6/2007 | Hughes |
| 7,390,032 | B2 | 6/2008 | Hughes |
| 7,493,960 | B2 | 2/2009 | Leising et al. |
| 7,494,159 | B2 | 2/2009 | Sugino et al. |
| 7,559,583 | B2 | 7/2009 | Stoetzer |
| 7,581,602 | B2 | 9/2009 | Lorger et al. |
| 7,762,824 | B2 | 7/2010 | Smith, III |
| 7,777,644 | B2 | 8/2010 | Madhavan et al. |
| 7,823,931 | B2 | 11/2010 | Hamamoto et al. |
| 8,739,861 | B2 | 6/2014 | Hughes et al. |
| 2003/0213598 | A1* | 11/2003 | Hughes ..... E21B 17/003 166/380 |
| 2008/0230218 | A1 | 9/2008 | Hall et al. |
| 2008/0230277 | A1 | 9/2008 | Hall et al. |
| 2009/0200798 | A1 | 8/2009 | Hamamoto et al. |
| 2010/0116509 | A1 | 5/2010 | Robert et al. |
| 2011/0180273 | A1 | 7/2011 | Hughes et al. |
| 2014/0050522 | A1 | 2/2014 | Slaughter |
| 2014/0054886 | A1 | 2/2014 | Hughes et al. |
| 2015/0008002 | A1 | 1/2015 | Hughes et al. |
| 2015/0176341 | A1 | 6/2015 | Hughes et al. |

FOREIGN PATENT DOCUMENTS

| | | |
|---|---|---|
| CN | 1527901 | 9/2004 |
| CN | 101705793 | 5/2010 |
| CN | 102900377 | 1/2013 |
| GB | 2233415 | 1/1991 |
| WO | WO 2005/026494 | 3/2005 |
| WO | WO 2009/148921 | 12/2009 |
| WO | WO 2011/092630 | 8/2011 |

OTHER PUBLICATIONS

"FarReach Alloy Drill Pipe" Alcoa, Technical Guide Version 2.0, Apr. 2011, 20 pages.
International Search Report for International (PCT) Patent Application No. PCT/IB11/50329 dated Jun. 21, 2011, 4 pages.
Written Opinion for International (PCT) Patent Application No. PCT/IB11/50329 dated Jun. 21, 2011, 7 pages.
International Preliminary Report on Patentability for International (PCT) Patent Application No. PCT/IB11/50329 dated Jul. 31, 2012, 8 pages.
Extended European Search Report for European Patent Application No. EP 11736688.0, dated Feb. 3, 2015, 10 pages.
International Search Report and Written Opinion for International (PCT) Patent Application No. PCT/IB/53036 dated Dec. 5, 2011, 10 pages.
International Preliminary Report on Patentability for International (PCT) Patent Application No. PCT/IB11/53036 dated Jan. 22, 2013, 8 pages.
Official Action for New Zealand Patent Application No. 601327 dated Apr. 26, 2013, 2 pages.
Official Action for New Zealand Patent Application No. 605385 dated Aug. 16, 2013, 3 pages.
Official Action for Australian Patent Application No. 2011210293 dated May 29, 2014, 4 pages.
Official Action for Canadian Patent Application No. 2,729,230 dated Jul. 17, 2014, 2 pages.
English Translation of Official Action for Chinese Patent Application No. 201180007741.7, dated Aug. 12, 2015, 8 pages.
English Translation of Official Action for Chinese Patent Application No. 201180007741.7, dated Sep. 5, 2016, 13 pages.
Official Action (English summary) for Mexican Patent Application No. MX/a/2012/008548, dated 2014, 2 pages.
English Translation of Official Action for Mexico Patent Application No. MX/a/2012/008548, dated 2015, 4 pages.
Official Action (English translation) for Eurasian Patent Application No. 201290708, dated 2014, 2 pages.
English Translation of Official Action for Eurasian Patent Aplication No. 201290708, dated Feb. 26, 2015, 2 pages.
Extended Search Report for European Patent Application No. 11806376.7, dated May 4, 2016, 9 pages.
Official Action for U.S. Appl. No. 12/695,569 dated Apr. 20, 2012, 6 pages.
Official Action for U.S. Appl. No. 12/695,569 dated Jun. 20, 2012, 10 pages.
Official Action for U.S. Appl. No. 12/695,569 dated Jan. 10, 2013, 8 pages.
Official Action for U.S. Appl. No. 12/695,509 dated Apr. 18, 2014, 8 pages.
Official Action for U.S. Appl. No. 12/695,569 dated Nov. 4, 2014, 8 pages.
Official Action for U.S. Appl. No. 14/069,824 dated Dec. 16, 2016, 13 pages.
Official Action for U.S. Appl. No. 13/178,446 dated Jul. 30, 2013, 23 pages.
Official Action for U.S. Appl. No. 13/178,446 dated Oct. 17, 2013, 23 pages.
Notice of Allowance for U.S. Appl. No. 13/178,446 dated Apr. 2, 2014, 5 pages.
Official Action for U.S. Appl. No. 14/636,592, dated Jul. 11, 2016, 10 pages.

* cited by examiner

TAPERED SPLINE CONNECTION FOR DRILL PIPE, CASING, AND TUBING

This application is a continuation of Ser. No. 14/636,592, filed Mar. 3, 2015, which is a continuation-in-part of now abandoned U.S. patent application Ser. No. 12/695,569, filed Jan. 28, 2010, the entire disclosures of which are incorporated by reference herein.

FIELD OF THE INVENTION

The present disclosure generally relates to drill pipe, casing, and tubing used to locate and produce hydrocarbons in a subterranean environment and more specifically to a connection for joining sections of one of drill pipe, casing, and tubing together.

BACKGROUND OF THE INVENTION

Large portions of hydrocarbon location and production activities involve drilling, pumping, and conduit installation beneath the earth's surface. Drilling, pumping, and conduit installation operations may include water location and distribution. Drilling, pumping, and conduit installation operations may also include sewage processing and distribution, or support installation of electrical power lines or telecommunications transmission lines. Drilling, pumping, and conduit installation activities often use lengths of pipes, which may be joined together in a variety of different manners. There are several considerations associated with joining pipes. For example, drilling activities may require torque to be transmitted across numerous pipes. Thus a joint may need to be strong enough to transmit torque and resist failure.

Additionally, some industry standards exist related to pipe section diameters. For example, internal pipe diameters are often standardized so expected flow and capacity of the drill string can be achieved. Standards also exist concerning pipe outer diameters that dictate clearances between the outer pipe surface and a wellbore casing, for example. Thus there are often limits on material sizes and thicknesses that can be used for drill pipe segments.

Currently, pipe segments are joined with threaded connections. Although a threaded connection will adequately join pipe segments, a threaded connection does not transfer torque effectively while rotating both to the left and to the right. That is, threads may loosen or disengage when the pipe segments are rotated in a direction opposite the direction used to tighten to pipe segments together. Some have addressed this issue by adding teeth to the ends of threaded joint sections. Teeth may be capable of transferring torque interconnected pipe segments, even if the pipe segments are rotated in a direction counter the tightening direction. But teeth are often ineffective and result in a weakened joint.

Drill pipe segments of the prior art are often made of steel alloy, such as 4140 steel or other steel alloys. As one of ordinary skill in the art will appreciate, such pipe segments are heavy and difficult to manage. As described in U.S. Pat. No. 3,126,214 to Wong, previous attempts to reduce drill pipe weight entailed providing an aluminum drill pipe with stainless steel joints adapted to interconnect two or more drill pipe segments together. For example, FIG. 1 shows interconnected drill pipe segment of the prior art comprising a male joint section 1 and a female joint section 2. The male joint section 1 and the female joint section 2 are connected to the aluminum drill pipe section 4 via threads provided on each of the male and female joint sections and the aluminum pipe section 4. In the example shown, the aluminum pipe section 4 possesses outer threads 6 and the male and female joint section includes internal threads 5. The outer diameter 8 of the drill pipe section 4 is larger than the internal diameter 7 of the male and female joint sections. Thus, to interconnect the male and female joint sections to the aluminum drill pipe section, the joint sections must be heated to approximately 650° F., which expands the joint sections so they can be threadingly received on the aluminum drill pipe section. After the threaded connections are engaged, the male and female joint sections are allowed to cool, or forcibly cooled by water spray, which bonds the joint sections to the aluminum pipe section.

One of ordinary skill in the art will appreciate that one drawback of the current method of joining stainless steel joint sections 2 and aluminum drill pipe section is that premature joint section cooling will prevent complete integration of the joint section to the pipe section. If the interconnection of joint section to pipe section is not ideal, the joint section cannot simply be removed by re-heating, as the heat required for joint section expansion will adversely affect the aluminum drill pipe section.

It is appreciated that one may postulate that further weight reductions can be achieved if both the drill pipe section and the joint sections are made of aluminum. The use of an aluminum drill pipe with threaded end interconnections as found in the prior art would weaken the drill string because under the conditions normally experienced in drilling operations, the threads of interconnected aluminum drill pipe joint segments would adhere and gall. Galling may lead to catastrophic failure. Further, even if an anti-galling coating is used, aluminum threads are weak and, thus, are not ideal to transfer torque.

Those of ordinary skill in the art will also appreciate that because steel joints are the widest portion of the drill pipe segment and, thus, the drill string; they often contact cement and casing walls or the stone wellbore. Abrasive contact between joint sections and the wellbore tends to wear the joint sections. Accordingly, hard bands are often integrated into the steel joint sections before they are connected to the aluminum pipe section. Hard bands are designed as a sacrificial surface that bears the brunt of the frictional interaction between the drill string and the wellbore. Thus the joint members must be re-banded from time to time which is done by removing the existing band and welding a new band onto the joint section. The excess heat required by this process will degrade the interconnected aluminum pipe.

Accordingly, a need exists for a method and apparatus, which takes into account one or more of the issues discussed above as well as possibly other issues.

SUMMARY OF THE INVENTION

One embodiment of the present invention is a drill pipe segment comprising: 1) a pipe section; 2) a first, male joint section; and 3) a second, female joint section. Those of skill in the art will appreciate that drill pipe segments are often referred to as "joints," wherein a drill string is comprised of a plurality of interconnected joints. Further, a "joint" of the prior art comprises a drill pipe having "tool joints," e.g., male and female connecting members, at each end. The first joint section includes a first number of splines, and the second joint section includes a second number of splines. The drill pipe segment has a circumferential outer surface that defines a longitudinal axis. The first number of splines extend in a direction generally parallel to the longitudinal axis and span a circumferential outer surface of the first joint section. Likewise, the second number of splines extend in a direction generally parallel to the longitudinal axis and span a circumferential outer surface of the second joint section. Each of the first number of splines and the second number of splines have a base, a tip, and a pair of flanks that extend from the base to the tip. The pair of flanks may form an acute angle. Each of the first number of splines is configured to be received between pairs of splines in the second number of splines of another drill pipe segment to form a connection between two drill pipe segments.

It is a further aspect of embodiments of the present invention described above to provide a coupling for securing the first joint section to the second joint section. More specifically, the coupling may be associated with the first joint section of the drill pipe segment. The second joint section includes a plurality of external threads that selectively interface with the internal threads of the coupling. The first joint section also has external threads that selectively interconnected to threads of a load ring. In operation, the coupling is moved away from the first joint section to expose the external threads of the first joint section, and the load ring is interconnected to the first joint section. The splines of the first joint section and the splines of the second joint section of another drill pipe segment are intermesh as the two drill pipe segments are interconnected. Finally, the coupling is threadingly interconnected to the second joint section, wherein excess movement of the coupling along the longitudinal axis is prevented by the load ring. Thus a rigid connection of two drill pipe segments is provided that can accommodate torque and axial loads often encountered during drilling operations.

It is yet another aspect of embodiments of the present invention to provide a drill string that is formed of a plurality of aluminum drill pipe segments joined by steel couplings. Those of ordinary skill the art will appreciate that "aluminum" means aluminum, aluminum alloys, or any other material that exhibits the properties of aluminum, such as corrosion resistance, reduced weight, strength, toughness, etc. Those of ordinary skill the art will also appreciate that "steel" means steel, stainless steel, and other alloys of steel, or any other material that exhibits the properties of steel, such as strength and durability.

The aluminum drill pipe segment of embodiments of the present invention does not require hard banding. More specifically, as the hard ban wears, the coupler can be removed from the drill pipe segment by slipping it over the second joint section. A new coupler can then be added to the drill pipe segment and the old coupler can be discarded, recycled, or repaired/reused. Of course, the coupler can be hard banded, and the hard band can be repaired away from the aluminum drill pipe section wherein the increase heat required for such repair will not affect the aluminum drill pipe section.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and advantages thereof, will best be understood by reference to the following detailed description of an illustrative embodiment of the present invention when read in conjunction with the accompanying drawings, wherein:

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
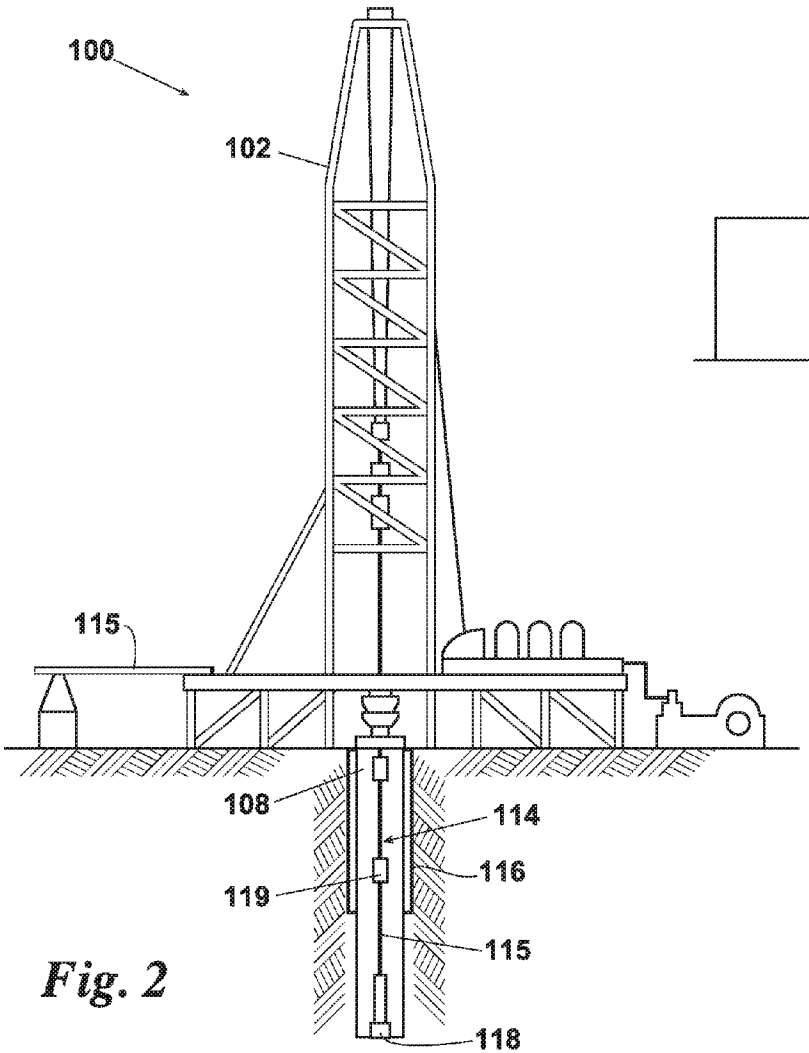
FIG. 2 shows a hydrocarbon drilling environment in accordance with an illustrative embodiment.

FIG. 2 shows a common hydrocarbon drilling environment that employs one or more of the embodiments of the present invention described herein. In this illustrative example, hydrocarbon drilling environment 100 includes drilling derrick 102 that is used to create and access a borehole 108. The derrick 102 includes drill string 114, casing 116, and a drill bit 118 that forms the borehole 108. The drill string 114 may include any number of drill pipe segments 115 connected end to end using connectors 119. In one embodiment, the drill pipe segments 115 are made of aluminum and the connectors 119 are made of stainless steel.

Figure 1:
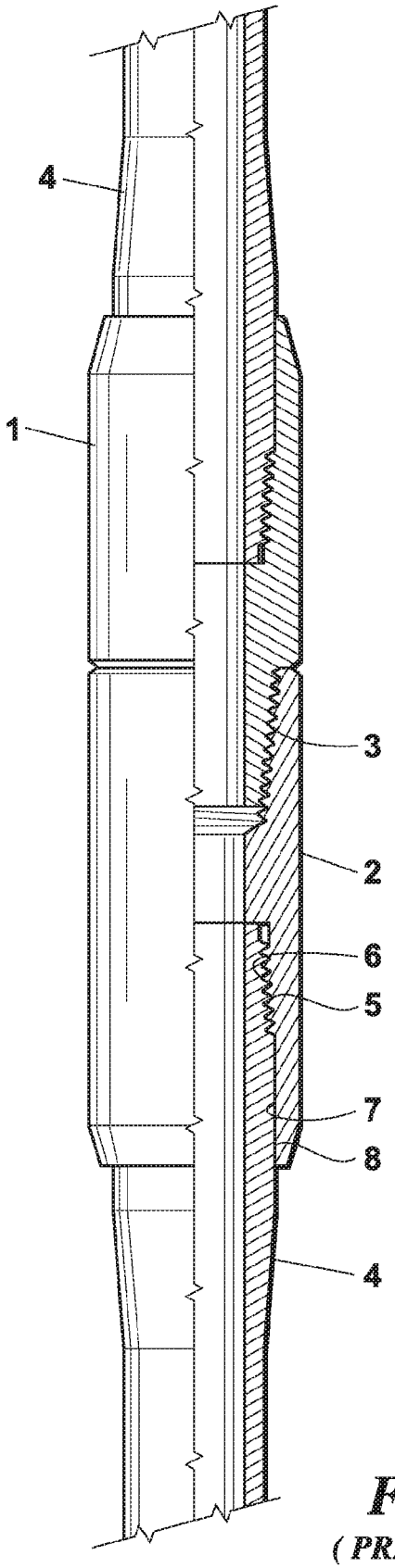
Fig. 1 ( PRIOR ART )
FIG. 1 shows a prior art method of joining drill pipe segments.
Figure 3:
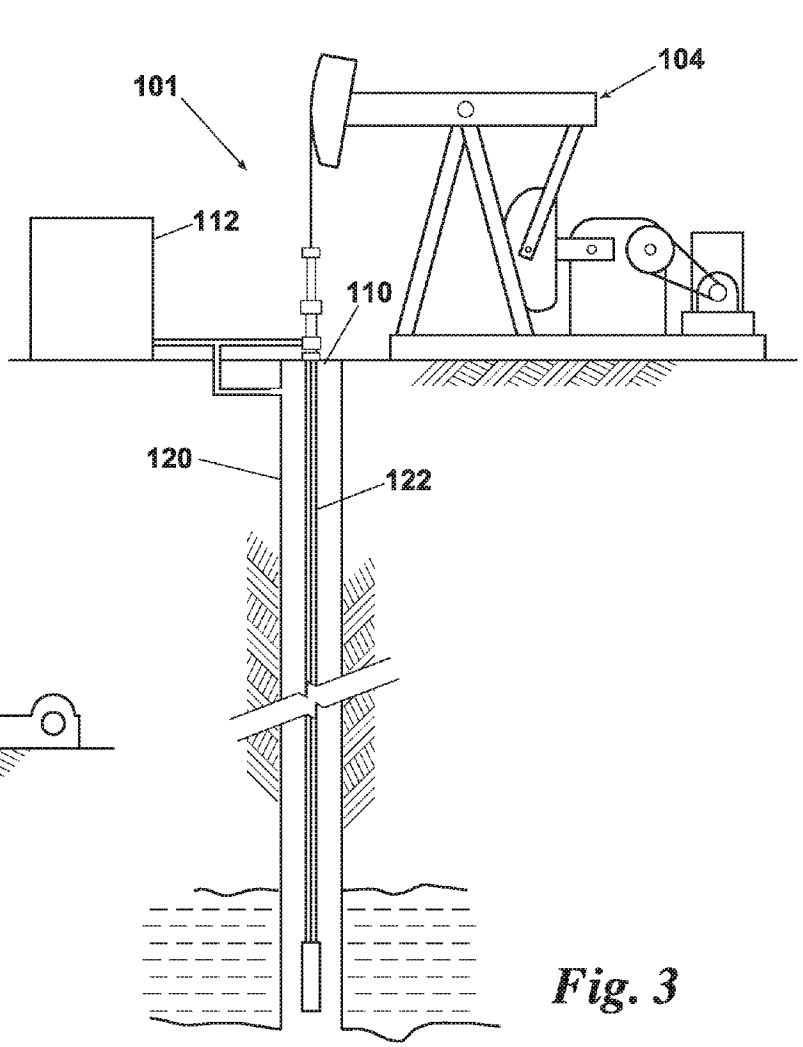
FIG. 3 shows a hydrocarbon production environment in accordance with an illustrative embodiment.

FIG. 3 shows a common hydrocarbon production environment that employs one or more of the embodiments of the present invention described herein. The hydrocarbon production environment 101 includes a pump jack 104 and a storage center 112. The pump jack 104 uses tubing 112 to produce hydrocarbons such as oil and gas, for example, from the borehole 110.

Figure 4:
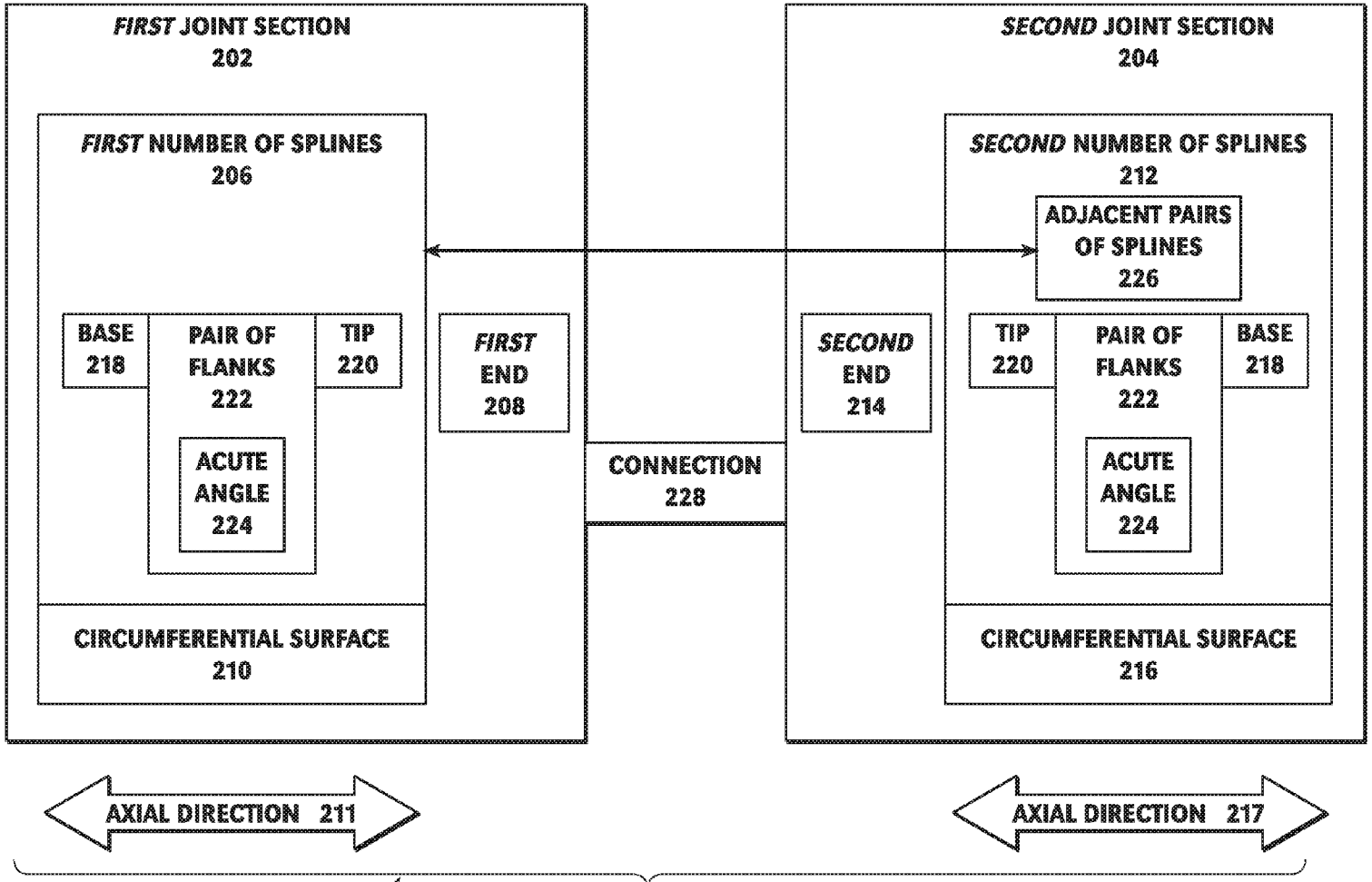
FIG. 4 is a block diagram of connection in accordance with an illustrative environment.

FIG. 4 is a block diagram of a connection in accordance with one embodiment of the present invention. In this example, the connection 200 includes first joint section 202 and second joint section 204. For example, the first joint section 202 or second joint section 204 may be associated with a cylindrical object, e.g., a drill pipe segment. The first joint section 202 includes first number of splines 206 located near a first end 208 of the first joint section 202. The first number of splines 206 span a circumferential surface 210 of the first joint section 202. The first number of splines 206 also extend in an axial direction 211 of the first joint section 202. Similarly, the second joint section 204 includes a second number of splines 212 located near a second end 214 of the second joint section 204. The second number of splines 212 span circumferential surface 216 of the second joint section 204. The second number of splines 212 also extend in axial direction 217 of second joint section 204. As used herein, a circumferential surface, when referring to objects, is a surface of the object that bounds the object in a circular fashion. For example, a circumferential surface may be a surface corresponding to an inner circumference of a cylinder. A circumferential surface may also be a surface corresponding to an outer circumference of a cylinder. Also used herein, an axial direction when referring to cylindrically shaped objects means a direction substantially parallel to the center axis of the cylindrically shaped object.

In this illustrative embodiment, splines in both the first joint section 202 and the second joint section 204 have a shape defined by base 218, tip 220, and pair of flanks 222 that extends from base 218 to tip 220. The pair of flanks also form acute angle 224. Each spline in first number of splines 206 is configured to be received between adjacent pairs of splines 226 in second number of splines 212 of another drill pipe segment as first end 208 of the first joint section 202 and second end 214 of the second joint section 204 are joined together to form connection 228 between the first joint section 202 and the second joint section 204. The illustration of connection 200 in FIG. 4 is not meant to imply physical or architectural limitations to the manner in which different illustrative embodiments may be implemented. Other components in addition to, or in place of, the ones illustrated may be used. Some components may be unnecessary in some illustrative embodiments. Also, the blocks are presented to illustrate some functional components. One or more of these blocks may be combined and/or divided into different blocks when implemented in different illustrative embodiments.

As one of skill in the art will appreciate, the first joint section 202 and the second joint section 204 may be a tool joint. The first joint section 202 and the second joint section 204 may be secured to ends of drill pipes. The first joint section 202 and the second joint section 204 may also be formed on surfaces of drill pipes near the end of the drill pipes. The first joint section 202 and the second joint section 204 may have different inner diameters and outer diameters. For example, without limitation the first joint section 202 and the second joint section 204 may be a connection section for pipes having three and a half inch diameters, five inch diameters or any other sizes suitable for use in locating or producing hydrocarbons. In other embodiments, splines in the first number of splines 206 and the second number of splines 212 may be different sizes than each other. Splines in the first number of splines 206 and the second number of splines 212 may also have different spacing from each other to receive different sizes of splines.

Figure 5:
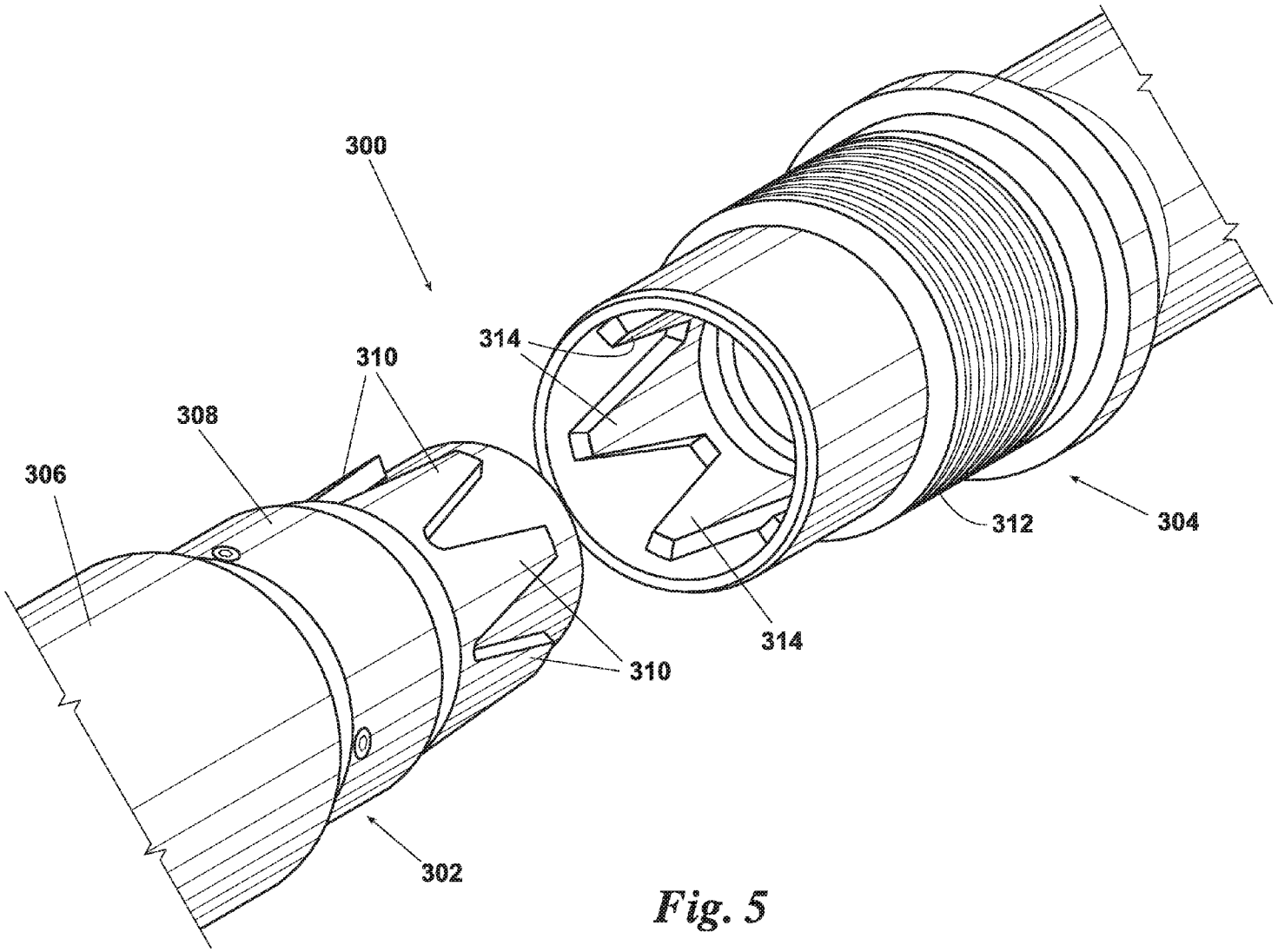
FIG. 5 is a perspective view of two pipe segments to be joined together in accordance with an illustrative embodiment.

FIG. 5 shows a connection for two drill pipe segments wherein a first male joint section 302 is shown spaced from the second female joint section. A coupling 306 and load ring 308 are associated with the first joint section 312. The coupling 306 is configured to slide over load ring 308 until it is stopped by the load ring 308, which will be described in further detail below. The coupling 306 also has threads on an inner surface, which cannot be seen in this particular illustration. The second pipe joint section 304 also includes threads 312. The threads 312 are configured to receive the threads on the inner surface of coupling 306. In this example, threads 312 are right hand threads, though left hand threads may be used in alternative embodiments. Both the first joint section and the second joint section include splines 310 and 314.

In one embodiment of the present invention, the first joint section 302 and the second joint section 304 are made of aluminum or an aluminum alloy, and the coupling 306 is made of steel, a steel alloy, or a variation thereof. The load ring 308 may also be made of aluminum or steel. In operation, the splines 310, 314 of adjoining drill pipe segments are interconnected as described below with regard to FIGS. 8-11. The coupling of the first joint section 302 is then fitted over the second joint section 304 and the threads of the coupling are interconnected to the threads 312 of the second joint section 304. The steel threads of the coupling 306 and the aluminum threads of the second joint section 304 are compatible and incidences of galling are greatly reduced. The splines 310, 314 of each joint section provide the ability for the drill pipe string to transfer torque, regardless of the drill string rotation direction, and the steel coupler 306 axially interconnects the pipe segments.

Figure 6:
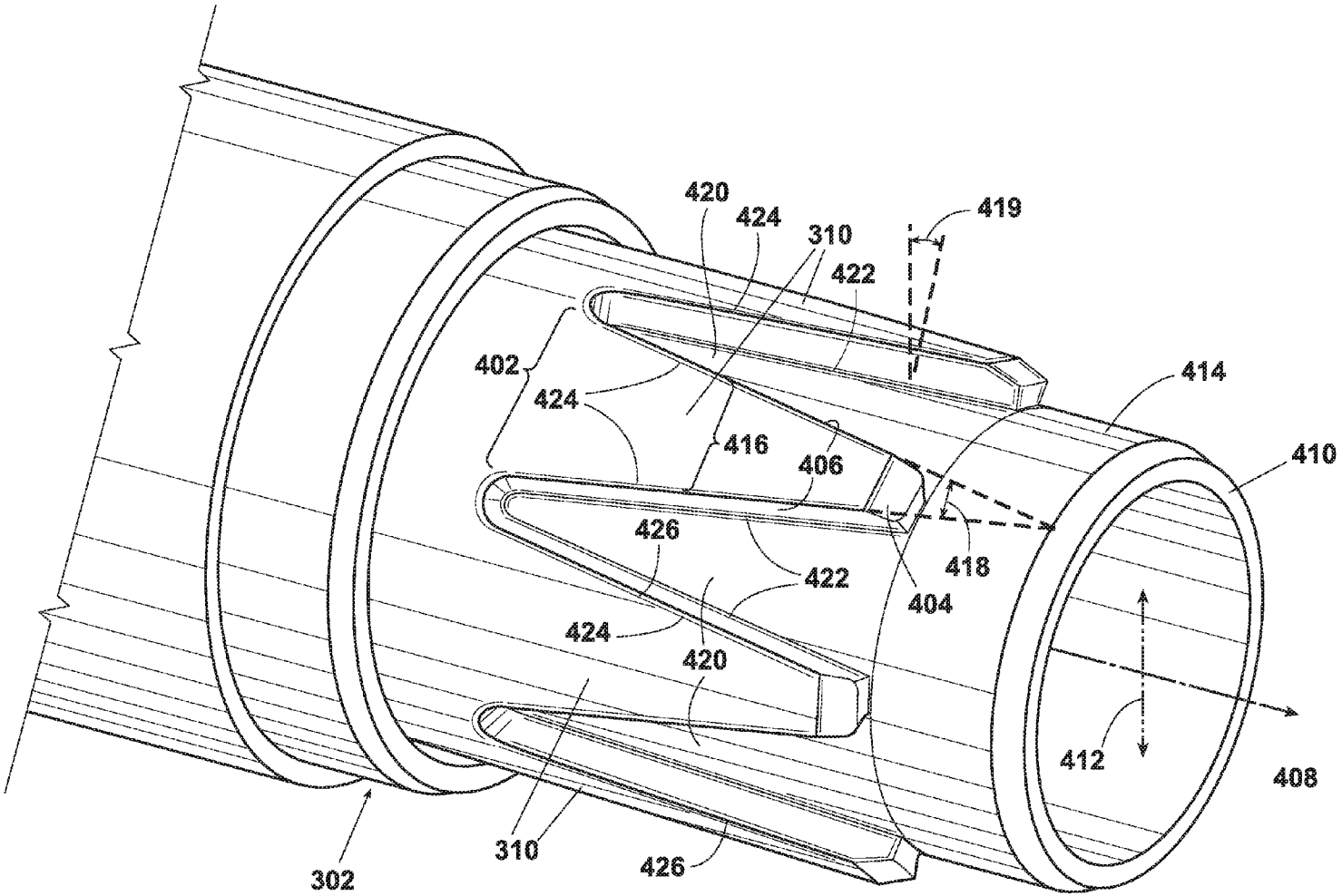
FIG. 6 is a detailed view of a male joint section of a pipe segment in accordance with an illustrative embodiment.

FIG. 6 is a detailed view of a drill pipe segment of a joint section of one embodiment of the invention. Here, the first joint section 302 and plurality of splines 310 are depicted with greater detail. Each of plurality of splines 310 have a base 402, a tip 404, and pair of flanks 406. In this example, each of plurality of splines 310 extend from the base 402 in axial direction 408 towards end 410 of first joint section 302. Each of plurality of splines 310 also extends outwardly in radial direction 412 from outer surface 414 of first joint section 302. Also as used herein, a "radial direction" or "radial extension," when referring to cylindrically shaped objects means a direction substantially perpendicular to the center axis of the cylindrically shaped object.

Plurality of splines 310 are also tapered, meaning that as plurality of splines extend from base 402 towards tip 404 width 416 of plurality of splines 310 decreases. For example, this decrease in width 416 is attributable to spline flank angle 418. Spline flank angle 418 is the angle between pair of flanks 406. Each flank in pair of flanks 406 form flank face angles 419 as each flank extends in radial direction 412 from outer surface 414. Additionally, the radial extension of plurality of splines 310 from outer surface 414 form recessed areas 420 between each of plurality of splines 310.

In this illustrative embodiment, plurality of splines 310 also includes root radii 422 as well as chamfers 424. Root radii 422 are the small edging portions near the interface between plurality of splines 310 and outer surface 414 of first joint section 302. Chamfers 424 are the rounding off or reduction of edge 426 of plurality of splines 310.

Figure 7:
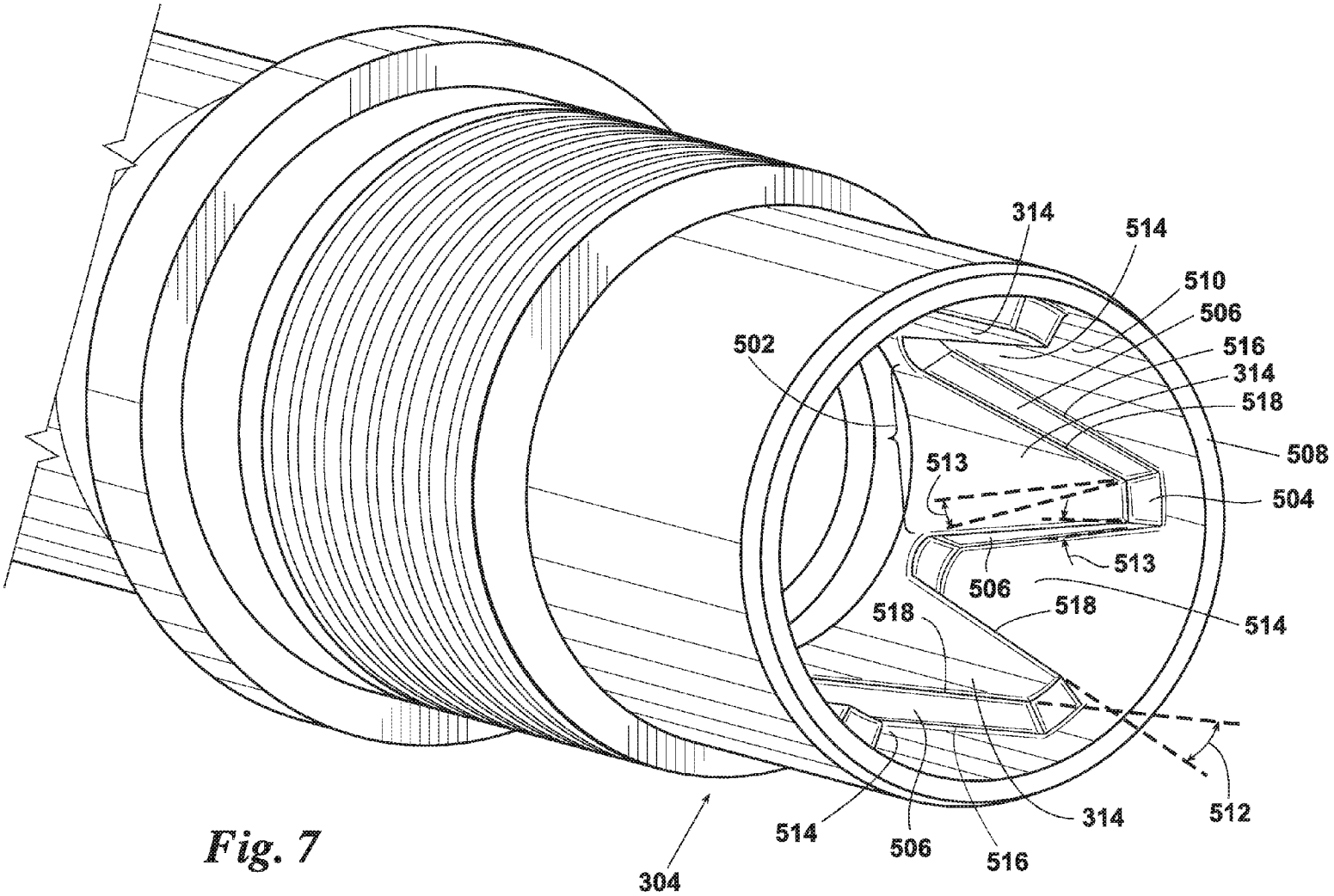
FIG. 7 is a detailed view of a female joint section of a pipe segment in accordance with an illustrative embodiment.

FIG. 7 shows the second joint section 304 and its plurality of splines 314. The shape of the plurality of splines 314 is similar to the shape of the plurality of splines 310 shown in FIG. 6. That is, each of plurality of splines 314 also have base 502, tip 504, and pair of flanks 506. Each of plurality of splines 314 extend from base 502 in an axial direction towards end 508 of the second joint section 304. However, each of plurality of splines 314 extends inwardly in a radial direction from inner surface 510 of the second joint section 304. Like the plurality of splines 310, the plurality of splines 314 are tapered and have spline flank angle 512 between pair of flanks 506. Each flank in pair of flanks 506 form flank face angles 513 as each flank extends in a radial direction from inner surface 510. Additionally, the radial extension of plurality of splines 314 from inner surface 510 form recessed areas 514 between each of plurality of splines 314.

In this illustrative embodiment, plurality of splines 314 also includes root radii 516 as well as chamfers 518. Root radii 516 and chamfers 518 may be another example of root radii 422 as well as chamfers 424 in FIG. 6. Root radii 516 provide additional support for plurality of splines 314. Chamfers 518 allow splines of opposing joint sections, such as plurality of splines 310 in FIG. 6 for example, to match with and be received between splines in plurality of splines 314. Root radii 516 as well as chamfers 518 may also reduce wear and deformation of the edges of the splines, such as edge 426 of plurality of splines 310 in FIG. 6. Root radii 516 and chamfers 518 may also reduce a tendency for edges of opposing splines to become stuck together during connection and separation stages.

Figure 8:
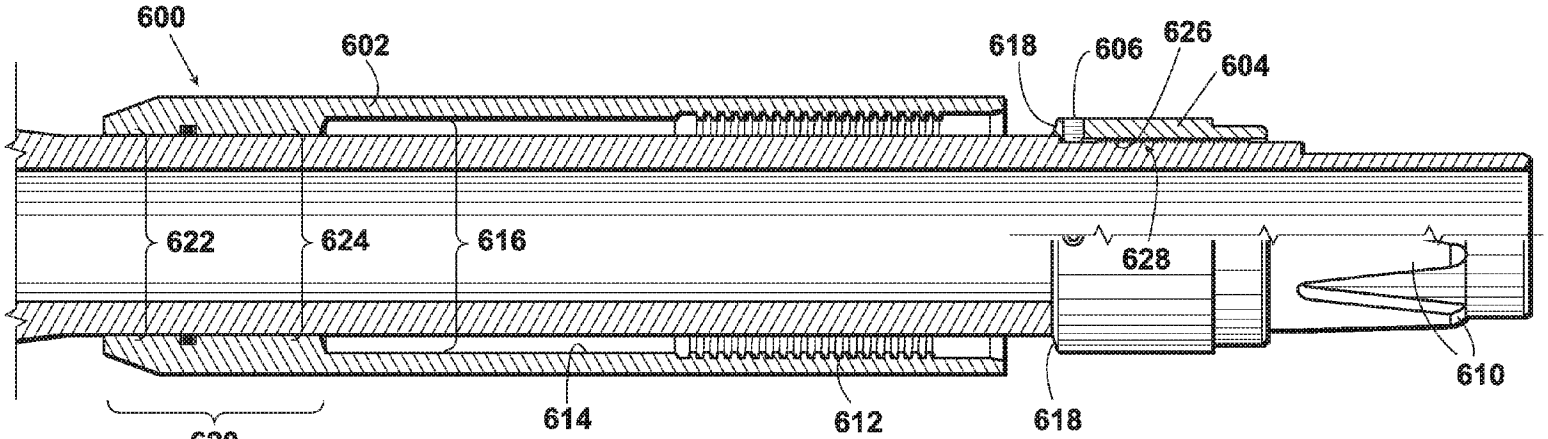
FIG. 8 is a cross-sectional view of a male joint section of an upper pipe segment in accordance with an illustrative embodiment.

FIG. 8 is a cross-sectional view of a first joint section that is integrated onto one end of a drill pipe segment 600. In this illustrative example, the first joint section 600 includes the coupling 602, load ring 604, set screws 606, and plurality of splines 610. The coupling 602 has set of threads 612 formed on inner surface 614. Inner surface 614 of coupling 602 has diameter 616 that is substantially equal to an outer diameter 618 of load ring 604. This configuration allows inner surface 614 of coupling 602 to slide in the axial direction around load ring 604. On the other hand, portion 620 of coupling 602 has inner diameter 622 that is substantially smaller than diameter 616 of inner surface 614. Inner diameter 622 is also substantially equal to outer diameter 624 of the first joint section 600. The inner diameter 622 is substantially equal to outer diameter 624 of first joint section 600 allows coupling 602 to slide around the load ring 604 until the point where portion 620 of coupling 602 contacts load ring 604.

As depicted, the load ring 604 has set of inner threads 626 that are matched to threads 628 located on the first joint section 600. The set of inner threads 626 allow the load ring 604 to be rotated onto threads 628 located on the first joint section 600. Once in place, the load ring 604 may be secured to the first joint section 600 and secured using the set screws 606. Any number of set screws 606 may be used to lock the load ring 604 in place. In alternative embodiments, the load ring 604 may be formed on the first joint section 600. Thus, the load ring 604 and the first joint section 600 may be the same physical part.

Figure 9:
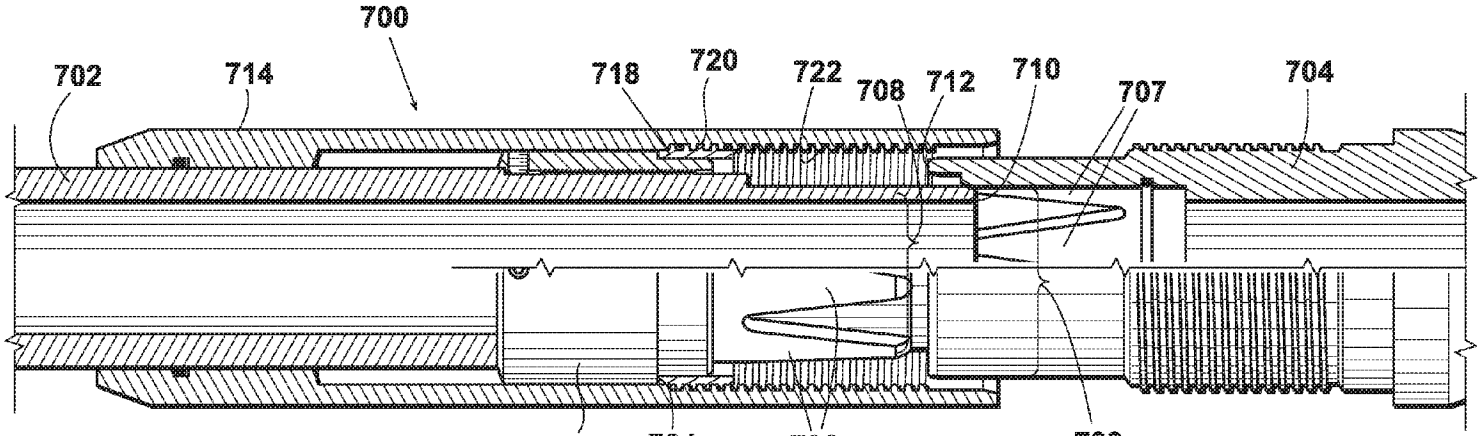
FIG. 9 is a cross-sectional view of male and female joint sections at an initial engagement stage in accordance with an illustrative embodiment.

Turning now to FIG. 9, an illustration of a side cross-sectional view of a pair of joint sections at an initial engagement stage is depicted in accordance with an illustrative embodiment. In this illustrative example, connection section 700 includes upper joint section 702 and lower joint section 704. Connection section 700 is an example of one embodiment of connection section 300 in FIG. 5, while upper joint section 702 and lower joint section 704 may be examples of first joint section 302 and second joint section 304 in FIG. 5, respectively. As depicted, upper joint section 702 includes plurality of splines 706 on an outer surface. Similarly, lower joint section 704 includes plurality of splines 707 on an inner surface. In this example, outer diameter 708 of the first joint section 702 is less than inner diameter 709 of the second joint section 704. The outer diameter 708 of the first joint section 702 being less than inner diameter 709 of the second joint section 704 allows end 710 of the first joint section 702 to be placed inside end 712 of the second joint section 704. The outer diameter 708 of the first joint section 702 being less than inner diameter 709 of the second joint section 704 also allows plurality of splines 706 to be received and positioned in recesses between plurality of splines 707. Connection section 700 further includes coupling 714, the load ring 716, and a retaining ring 718.

In this illustrative embodiment, the retaining ring 718 restricts the coupling 714 from sliding in an axial direction away from lower joint section 704. The retaining ring 718 is positioned in the coupling 714 by engaging threads 720 of the retainer ring 718 with threads 722 of the coupling 714 when it is slid over the load ring 716. Once engaged, the retaining ring 718 then contacts a shoulder 724 of the load ring 716 to restrict the coupling 714 from sliding away from the load ring 716 and the second joint section 704.

Figure 10:
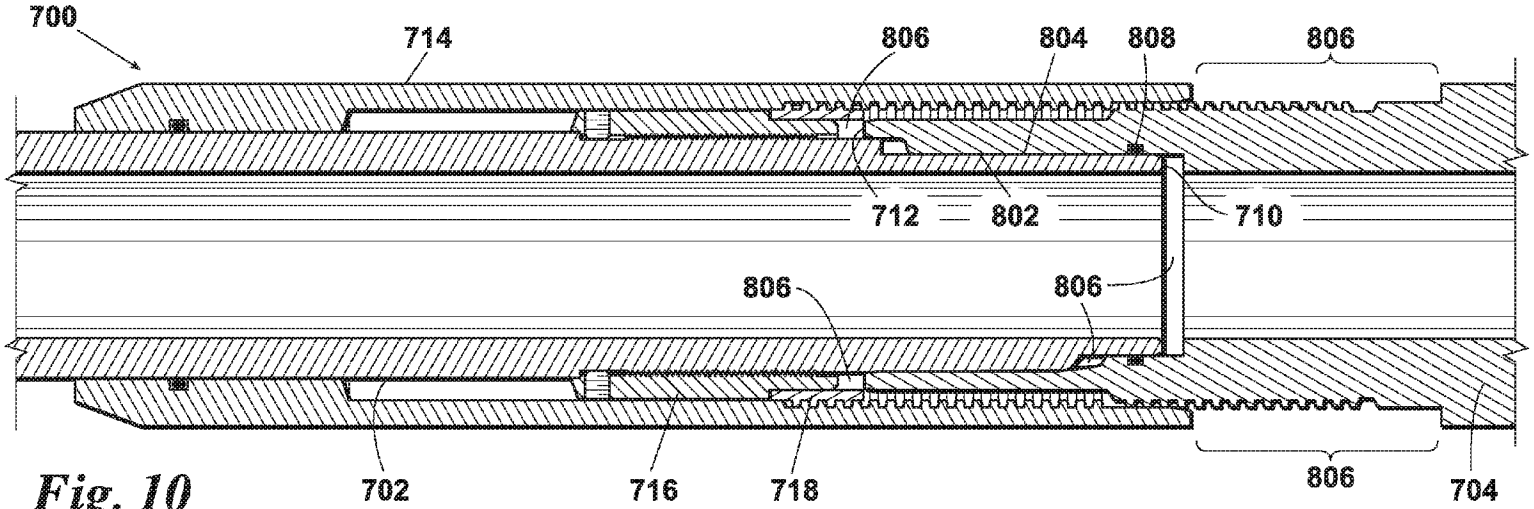
FIG. 10 is a cross-sectional view of male and female joint sections at an intermediate engagement stage in accordance with an illustrative embodiment.

FIG. 10, is a side cross-sectional view of a pair of joint sections at an intermediate engagement stage. Here, the first joint section 702 inserted inside end 712 of the second joint section 704. The first joint section 702 and the second joint section 704 are mated together. As depicted, outer surface 802 of upper joint section 702 and inner surface 804 of lower joint section 704 have diameters of similar size. These diameters of similar size allow outer surface 802 of upper joint section 702 to connect with inner surface 804 of lower joint section 704. On the other hand, in this example, ends 710 and 712 do not contact surfaces of lower joint section 704 and upper joint section 702, respectively. Because ends 710 and 712 do not contact surfaces of lower joint section 704 and upper joint section 702, ends 710 and 712 do not bottom out and gaps 806 exist. Gaps 806 extend in the axial direction between upper joint section 702 and lower joint section 704.

In this example, connection section 700 also includes a seal 808. The seal 808 is configured to prevent any leakage of fluids from the connection formed between outer surface 802 of upper joint section 702 and inner surface 804 of lower joint section 704. Additionally, filler may be inserted in gap 806 between end 710 of upper joint section 702 and end 712 of lower joint section 704. The filler may be made from a compressible material, such as, for example, without limitation, polymer or urethane material. For example, the filler may be a polymer ring. Fluids may flow through connection section 700 at certain pressures causing possible wear or erosion of components in connection 700. Inserting a filler in gap 806 in connection section 700 may reduce an amount of wear or erosion on end 710 of upper joint section 702 and end 712 of lower joint section 704.

Figure 11:
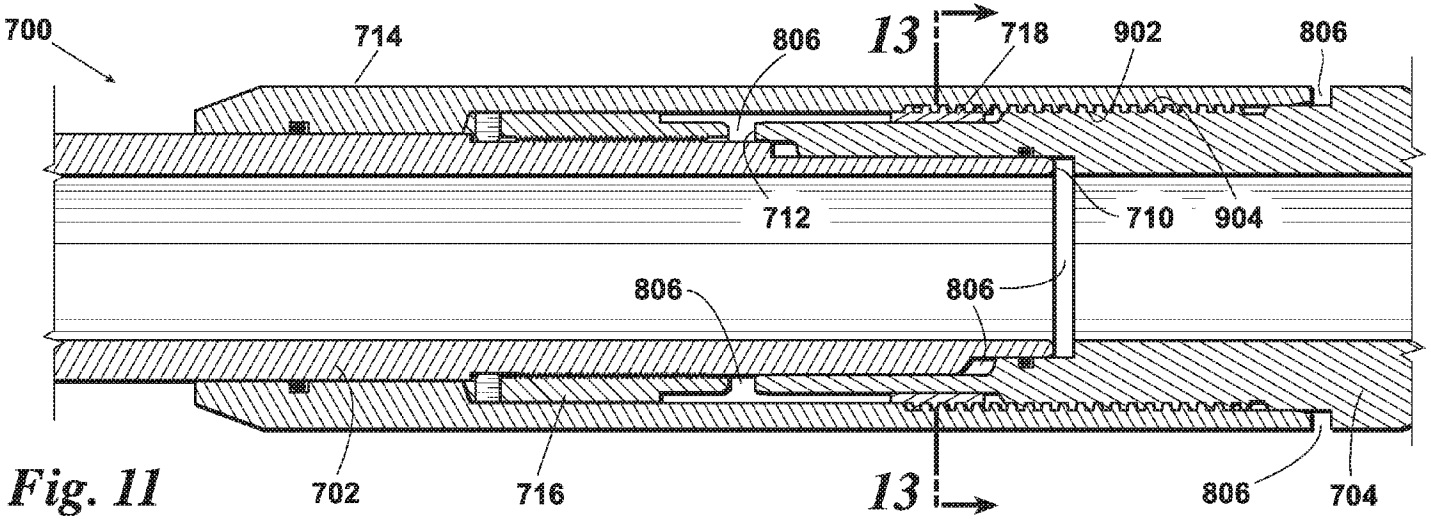
FIG. 11 is a cross-sectional view of male and female joint sections at a fully engaged stage in accordance with an illustrative embodiment.

With reference now to FIG. 11, an illustration of a side cross-sectional view of a pair of joint sections at a fully engaged stage is depicted in accordance with an illustrative embodiment. In this illustrative example, connection section 700 is depicted at a fully engaged stage. Coupling 714 has been shifted in the axial direction around lower joint section 704. Threads 902 located on an inner surface of coupling 714 have been received by and rotated onto threads 904 located on an outer surface of lower joint section 704.

In this depicted embodiment, as coupling 714 is shifted axially towards lower joint section 704, a point is reached where load ring 716 begins to physically resist further axial movement of coupling 714 towards lower joint section 704. At this point, further tightening of coupling 714 on threads 904 begins to force upper joint section 702 and lower joint section 704 further together. Forcing upper joint section 702 and lower joint section 704 together may reduce the axial distance of gaps 806 between upper joint section 702 and lower joint section 704. However, in this example, ends 710 and 712 do not bottom out on surfaces of lower joint section 704 and upper joint section 702. Thus, gaps 806 extending in the axial direction between surfaces of upper joint section 702 and lower joint section 704 remain.

Figure 12:
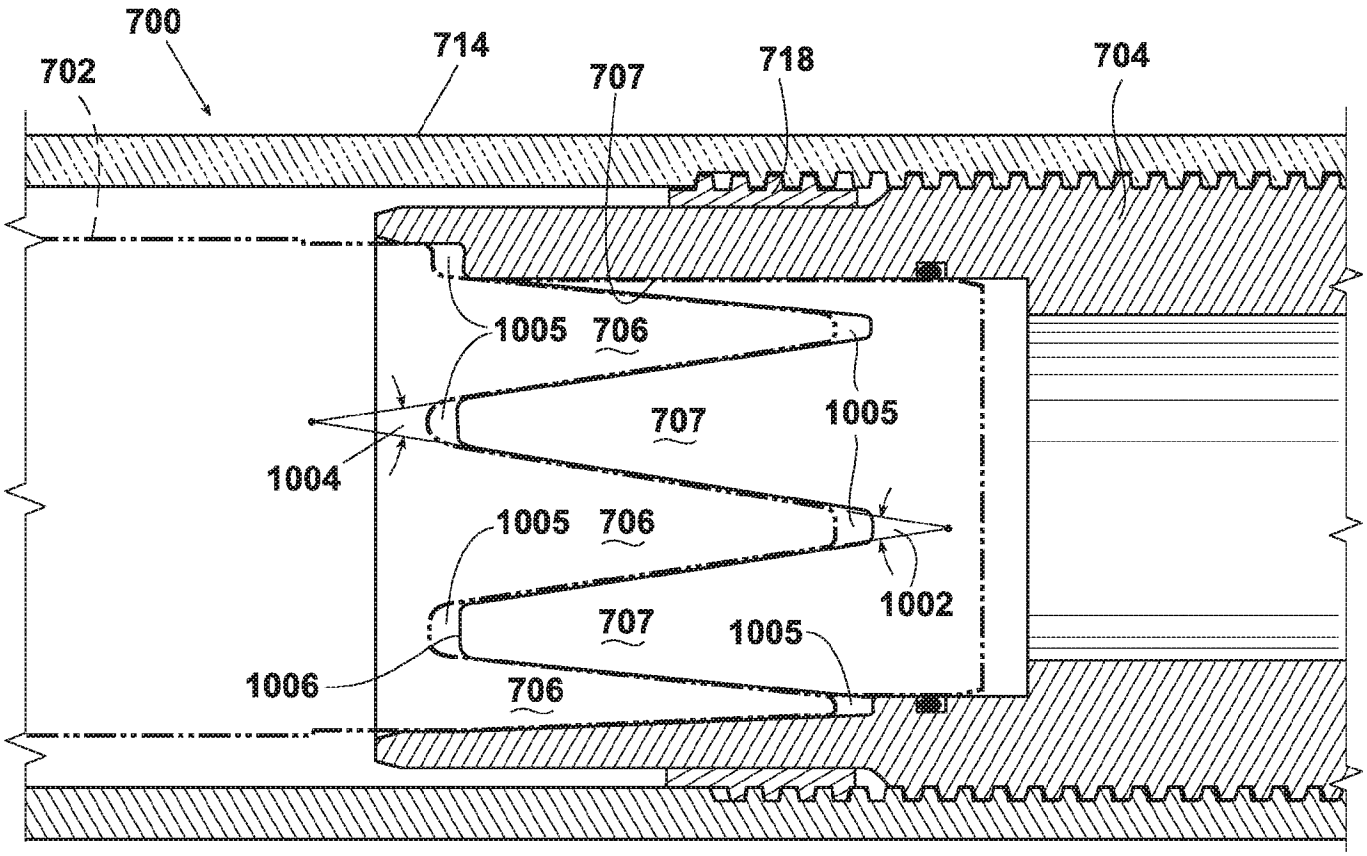
FIG. 12 is a cross-sectional view of male and female joint sections at a fully engaged stage in accordance with an illustrative embodiment.

With reference now to FIG. 12, an illustration of an internal cross-sectional view of a pair of joint sections at a fully engaged stage is depicted in accordance with an illustrative embodiment. In this illustrative example, connection section 700 at an engaged stage, such as illustrated in FIG. 10 and FIG. 11 for example, is seen from an internal view. This internal view provides greater detail regarding the position of plurality of splines 706 and plurality of splines 707.

As depicted, each spline of plurality of splines 706 is matched with a recessed area, such as one of recessed areas 512 in FIG. 7, located between adjacent splines of plurality of splines 707. Likewise, each spline of plurality of splines 707 is matched with a recessed area, such as one of recessed areas 420 in FIG. 6, located between adjacent splines of plurality of splines 706. In this example, the degree of spline flank angle 1002 is substantially equal to the degree of spline flank angle 1004. Because the degree of spline flank angle 1002 is substantially equal to the degree of spline flank angle 1004, each flank of the splines of plurality of splines 706 will come in contact with and seat on an opposing flank of a spline in of plurality of splines 707. Tightening of coupling 714 forces plurality of splines 706 between and towards plurality of splines 707. In this example, plurality of splines 706 and 707 also do not bottom out on opposing surfaces of upper joint section 702 and lower joint section 704. Thus, gaps 1005 are formed between tips 1006 of each of plurality of splines 706 and 707 and portions of the flanks of opposing splines. In this example, gaps 1005 may have a length that ranges from about 3/32 of an inch to about 9/32 of an inch in the axial direction. However, in other examples the length of gaps 1005 may be increased or decreased based upon a tightening and/or gap size considerations.

In this depicted embodiment, tightening of coupling 714 forces plurality of splines 706 between and towards plurality of splines 707. Preload in the connection caused by tightening of coupling 714 is generated from the mechanical advantage created by the wedge shape of the flanks of each of each of plurality of splines 706 and 707. As used herein, preload, when referring to a joint connection, refers to the force in a tightened joint connection prior to using the joint connection for its primary function. Preload is a compressive force resulting from two or more surface pairs being forced together during the assembly of a connection. The surfaces in compression can be tightened by any mechanical forces up to the yield strength of the surfaces in contact.

Preload increases the connection stiffness of connection 700 between upper joint section 702 and lower joint section 704. Connection stiffness is the resistance of a connection section to deflecting when external loads are applied to the pipe string. Preload in a connection allows the connection section between pipe joints to respond to forces as if the connection is a continuous section of pipe, because the connection section does not deflect. In this example, preload is applied to connection section 700 as upper joint section 702 and lower joint section 704 are forced together in the axial direction. Additionally, this preload is applied to surfaces of flanks of opposing splines. As gaps 1005 exist, the splines in connection section 700 have not bottomed out. Thus, additional tightening of coupling 714 increases an amount of preload in both the axial and circumferential directions for connection section 700.

In this illustrated embodiment, the angle selected for spline flank angle 1002 and 1004 has a value of about 18 degrees. However, in other advantageous embodiments spline flank angle 1002 and 1004 may be selected from a range between an angle having a value of about 10 degrees and an angle having a value of about 50 degrees. One of ordinary skill in the art would understand that as a spline flank angle approaches 90 degrees the mechanical advantage between opposing splines is reduced. Correspondingly, as a spline flank angle approaches zero degrees, disassembly of the joint sections may become more difficult once forces have been applied to the connection.

The tapered shape of plurality of splines 706 and 707 supplies a number of advantages to connection section 700. First, the tip of each of the splines is narrower than the base of the spline. The narrower tip fits within the larger recessed areas between the splines at an initial engagement stage, such as depicted in FIG. 9, for example. At such an initial engagement stage, a clearance exits between the narrower tip of the splines and the larger recessed areas. The clearance allows the splines to intermesh without the need for precise alignment at the initial engagement stage. Second, the area of contact between the flanks of the opposing splines allows torque to be transferred between upper joint section 702 and lower joint section 704. Transfer of torque between the flanks allows pipes connected by connection section 700 to be rotated either to the right or to the left without becoming disconnected. Further, as plurality of splines 706 are forced between and towards plurality of splines 707, the splines are wedged together. Wedging plurality of splines 706 and plurality of splines 707 together reduces possible radial gaps, such as joint slop for example, that may exist between flanks of opposing splines. Joint slop in a connection section may be any undesired gaps and/or lack of connection between surfaces of opposing joint sections. Wedging plurality of splines 706 and plurality of splines 707 together also forms a strong connection between upper joint section 702 and lower joint section 704. For example, the connection may be capable of withstanding levels of torque of about 15% or greater than the base pipe and about 70% or greater than connections used in current drilling applications.

Another advantage which may be attributable to the tapered shape of plurality of splines 706 and 707 is a reduction in the demand for machine tolerances. For example, irregularities may exist in one of more of the splines. One of the flanks of a spline may not be completely planar or the spline flank angle for one of the splines may not be formed to the exact degree desired. As the opposing splines are wedged together, the forces exerted on the splines adjacent to the spline having an irregularity may cause the irregular spline to deform. This deformation of the irregularity as the splines are wedged together may reduce problems caused by the irregularities.

The illustration of connection section 700 in FIG. 12 is not meant to imply physical or architectural limitations to the manner in which different illustrative embodiments may be implemented. Other components in addition to, and/or in place of, the ones illustrated may be used. Some components may be unnecessary in some illustrative embodiments. For example, in different illustrative embodiments any number of splines may be used. In other examples, splines may be any number of different sizes. Further, different illustrative embodiments may include splines having any number of different spline flank angles including angles beyond any previously discussed ranges. Still further, the spline flanks may be curved. For example, the spline flanks may have a slope that may be approximated by a parabolic curve. The spline flank angle may be formed by lines that are tangential to points on each flank in the pair.

Figure 13:
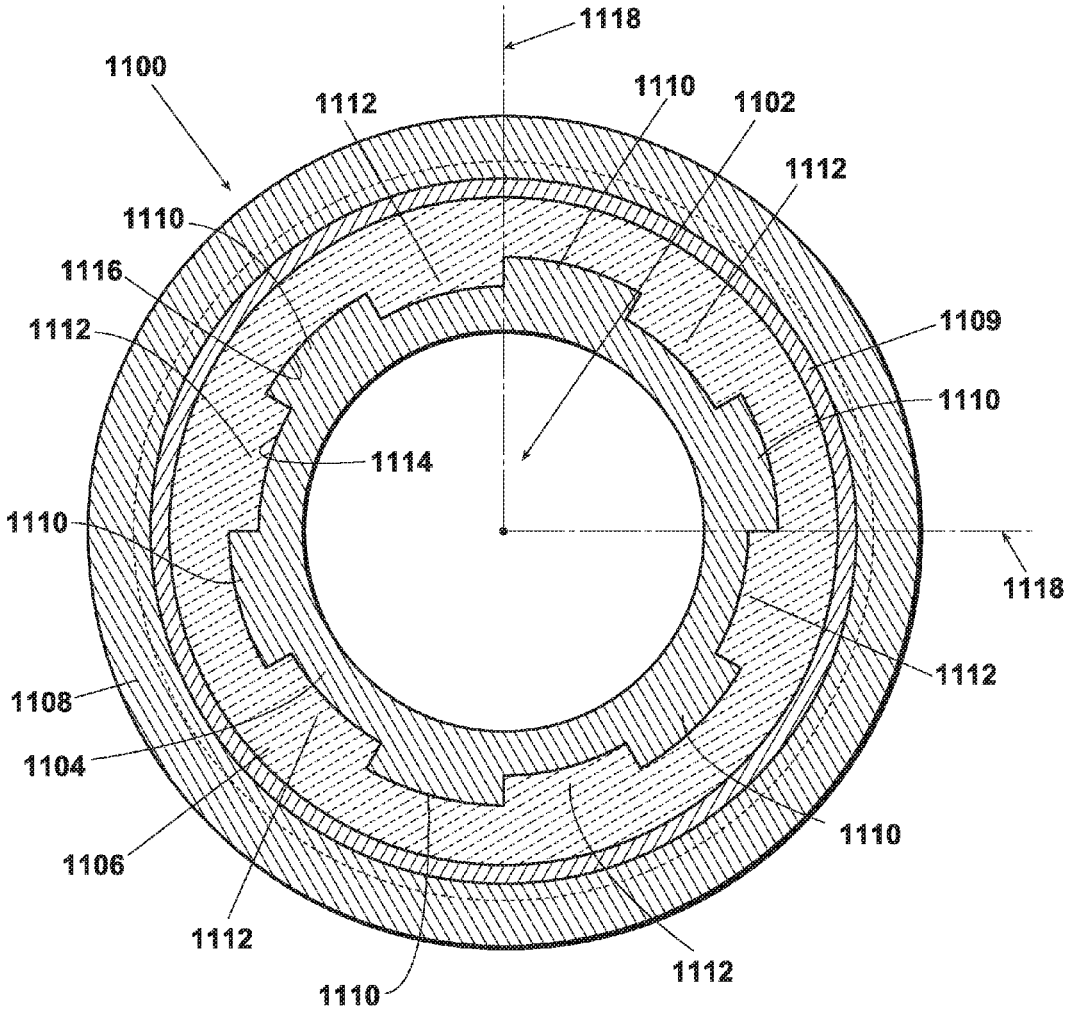
FIG. 13 is a cross-sectional center view of FIG. 12.

With reference now to FIG. 13, an illustration of a cross-sectional center view of a connection section at an engaged stage is depicted in accordance with an illustrative embodiment. In this illustrative example, connection section 1100 is seen from center view 1102. Connection section 1100 is an illustration of an example of one embodiment of connection section 700 in FIG. 9. Connection section 1100 includes male joint section 1104, female joint section 1106, coupling 1108, and retainer ring 1109. Male joint section 1104 includes plurality of splines 1110. Female joint section 1106 includes plurality of splines 1112. As can be seen, substantially no circumferential gaps occur between plurality of splines 1110 and 1112 because connection section 1100 is engaged.

In this illustrative embodiment, external forces applied to connection section 1100 are resisted by the connection stiffness of male joint section 1104 and female joint section 1106. Additionally, if torque were applied to connection section 1100, hoop stress and hoop tension would be experienced in connection section 1100. Hoop stress, in connection section 1100, is the resistance in male joint section 1104 that arrests retraction and the resistance in female joint section 1106 that arrests swelling as the two joint sections are compressed and/or rotated against each other. Hoop tension in connection section 1100 is the resisting force in the female joint section 1106 wall that provides support and counteracts the hoop stress in the male joint section 1104. For example, the thickness of inner wall 1114 of male joint section 1104 provides support for plurality of splines 1110. Support for plurality of splines 1110 provided by the thickness of inner wall 1114 of male joint section 1104 reduces the tendency for plurality of splines 1110 to retract. Inner wall 1114 also provides an area of support to reduce the exposure of plurality of splines 1110. The area of support provided by inner wall 1114 increases an amount of applied force that plurality of splines 1110 may withstand. In a similar manner, the thickness of outer wall 1116 of female joint section 1106 provides support for plurality of splines 1112. Support for plurality of splines 1112 provided by the thickness of outer wall 1116 of female joint section 1106 reduces the tendency for plurality of splines 1112 to expand. Outer wall 1116 also provides an area of support to reduce the exposure of plurality of splines 1112. The area of support provided by outer wall 1116 increases an amount of applied force that plurality of splines 1112 may withstand.

In addition, inner wall 1114 provides support in the area between the each spline in plurality of splines 1110. The support provided by inner wall 1114 reduces any tendency for splines of plurality of splines 1110 to shear inwardly. Similarly, outer wall 1116 provides support in the area between each spline in plurality of splines 1112. The support provided by outer wall 1116 reduces any tendency for splines of plurality of splines 1112 to shear outwardly. Thus, the cylindrical shape of inner wall 1114 and outer wall 1116 cause axial and torsional forces to be distributed evenly across plurality of splines 1110 and 1112 in connection section 1100. As torque is applied to one joint section, the torque is transferred to the other joint section through the plurality of splines 1110 and 1112 which are supported by the hoop stiffness caused by the cylindrically adjoined flanks. Thus, the overall torsional strength of the connection section 1100 is increased. As used herein, torsional strength, when referring to a connection section, means the amount of torsional forces the connection may withstand before the components of the connection section yield.

As depicted, both plurality of splines 1110 and 1112 have similar flank face angles 1118. In this illustrative embodiment, the angle of flank face angle 1118 is approximately 0 degrees. In this example, flank face angles 1118 are determined relative to the axis of the cylinder of connection section 1100. Flank face angles 1118 are an angle between a first line and a second line. The first line is perpendicular to the axis and intersects the spline flank at a point along the radial midpoint of the flank face. The second line is a line that is tangential to the point along the radial midpoint of the flank face that intersects with the first line. As depicted in FIG. 13 these two lines are substantially the same and thus the angle is approximately 0 degrees.

However, flank face angles 1118 may vary as the cross section of connection 1100 is shifted axially. For example, near the bases of splines in plurality of splines 1110 the flank face angle may be different than the flank face angle near the bases of splines in plurality of splines 1112. As depicted, in FIG. 13 flank face angles 1118 are zero degrees. The illustration of connection section 1100 in FIG. 13 may be at an axial midpoint of connection section 1100. The axial midpoint being the approximate midpoint between the bases of opposing splines in plurality of splines 1110 and 1112. As a cross-sectional view of connection section 1100 is shifted axially flank face angles 1118 may increase or decrease. Thus, flank face angles 1118 may vary in connection section 1100. Additionally, the flank face angle at a point on flanks in plurality of splines 1110 may be different than the flank face angle at a point on flanks in plurality of splines 1112.

Overall, flank face angle 1118 may be selected from a range between an angle having a value of about negative 30 degrees and an angle having a value of about 30 degrees. Additionally, flank face angle 1118 may vary in connection section 1100 from a range between an angle having a value of about negative 30 degrees and an angle having a value of about 30 degrees. Persons skilled in the art recognize and take note that an angle approaching 90 degrees may cause male joint section 1104 and female joint section 1106 to slip rotationally as torque load increases 1100. Persons skilled in the art recognize and take note that an angle approaching negative 30 degrees may cause the materials of the joint section to yield in response to certain levels of torque or other forces applied to connection section 1100.

The illustration of connection section 1100 in FIG. 13 is not meant to imply physical or architectural limitations to the manner in which different illustrative embodiments may be implemented. Other components may be added or substituted for the illustrated components. Some components may be unnecessary in some illustrative embodiments. For example, in different illustrative embodiments any number of splines may be used. In other examples, splines may be any number of different sizes. Further, different illustrative embodiments may include splines having any number of different flank face angles including angles beyond any previously discussed ranges. Moreover, different illustrative embodiments may combine splines with different flank face angles. Still further, the faces of flanks of splines in plurality of splines 1110 and 1112 may be curved.

Figure 14:
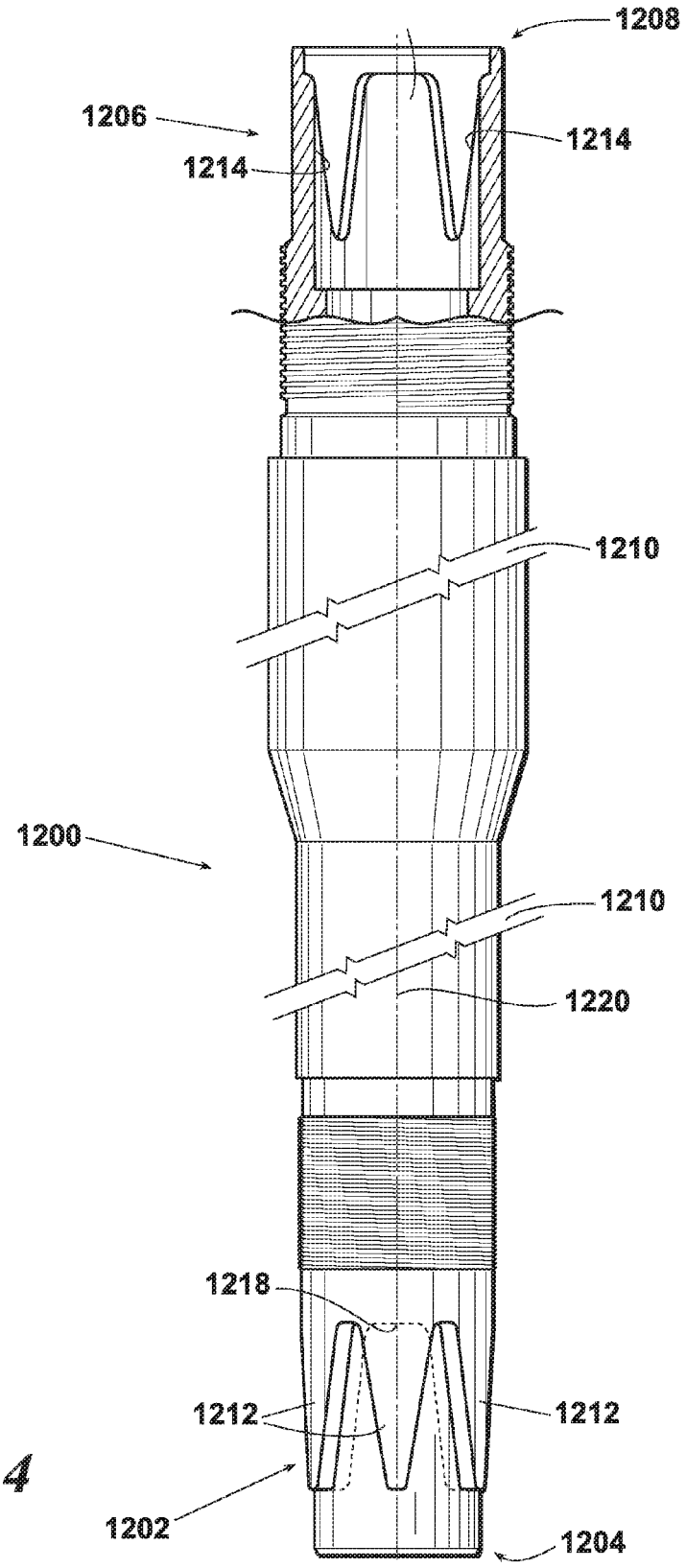
FIG. 14 is a front elevation view of a length of pipe having an orientation in accordance with an illustrative embodiment.

With reference now to FIG. 14, an illustration of a front view of a length of pipe having an orientation is depicted in accordance with an illustrative embodiment. In this illustrative example, pipe 1200 has first joint section 1202 at first end 1204 and second joint section 1206 at second end 1208. In this example, first joint section 1202 may be a male joint section, such as first joint section 302 in FIG. 5, and second joint section 1204 may be a female joint section, such as second joint section 304 in FIG. 5. Abbreviations 1210 are provided for illustrative purposes. Abbreviations 1210 allow greater detail of first joint section 1202 and second joint section 1206 to be seen on pipe 1200. Accordingly, pipe 1200 may not be illustrated to scale and may be longer than depicted.

In this illustrative embodiment, first joint section 1202 has plurality of splines 1212, while second joint section 1204 has plurality of splines 1214. Plurality of splines 1214 includes at least one spline, spline 1216, that is a different size than other splines in plurality of splines 1214. On the other end of pipe 1200, recessed area 1218 between splines in plurality of splines 1212 is larger than other recessed areas between splines in plurality of splines 1212. As depicted, both spline 1216 and recessed area 1218 are substantially centered on scribe line 1220. Scribe line 1220 is a reference line that extends from first end 1204 to second end 1208 on pipe 1200. In this example, centering both spline 1216 and recessed area 1218 along scribe line 1220 provides a particular orientation for pipe 1200.

In this illustrated embodiment, spline 1216 is larger than other splines in plurality of splines 1214. However, in other embodiments, splines 1216 may be smaller than other splines in plurality of splines 1214. In another example, splines 1216 may be tapered at a different angle than other splines in plurality of splines 1214. Still further, the different spline may be a part of one first joint section 1202 and any number of different sized splines may be used.

Figure 15:
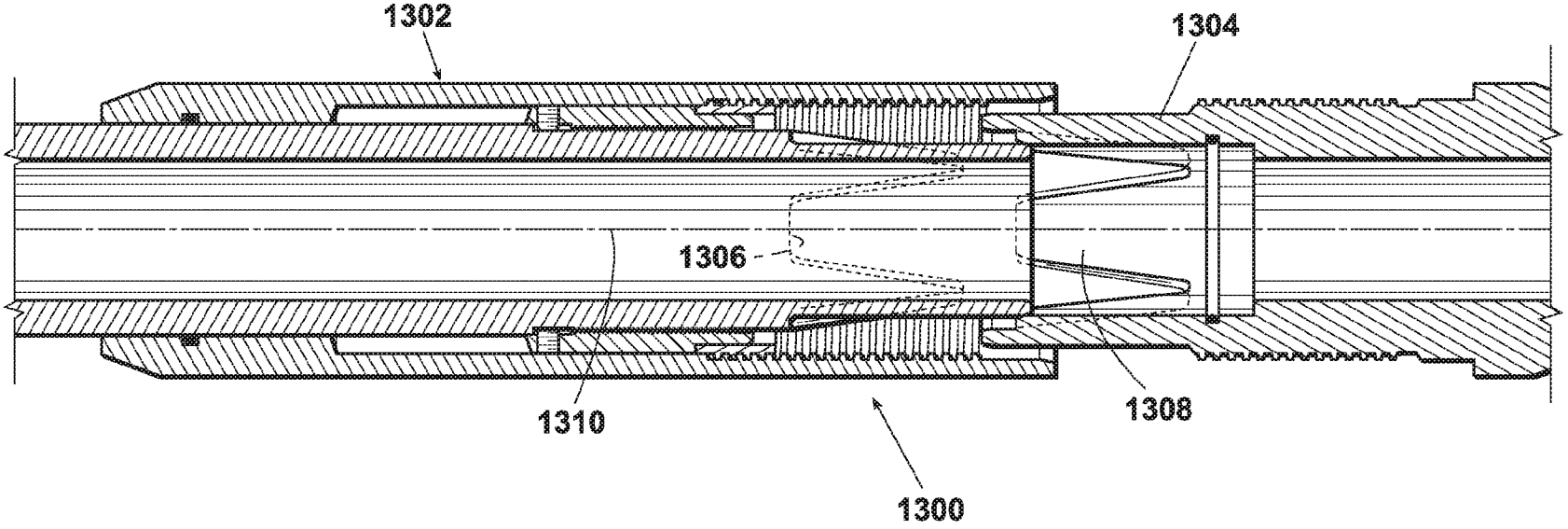
FIG. 15 is a cross-sectional view of male and female joint sections having an orientation at an initial engagement stage in accordance with an illustrative embodiment.

With reference now to FIG. 15, an illustration of a pair of joint sections having an orientation at an initial engagement stage is depicted in accordance with an illustrative embodiment. In this illustrative example, connection section 1300 is shown at an initial engagement stage similar to connection section 700 in FIG. 9, for example. In this example, connection section 1300 uses pipes that maintain a particular orientation, such as pipe 1200 in FIG. 14. Connection section 1300 includes upper joint section 1302 and lower joint section 1304. Upper joint section 1302 includes recessed area 1306 similar to recessed area 1218 in FIG. 14. Lower joint section 1304 includes spline 1308 similar to spline 1216 in FIG. 14.

Connection section 1300 is configured such that spline 1308 may only be fit into and be received by recessed area 1306 when upper joint section 1302 and lower joint section 1304 are fully engaged. Configuring connection section 1300 such that spline 1308 may only be fit into and be received by recessed area 1306 when upper joint section 1302 and lower joint section 1304 are fully engaged allows connection section 1300 to maintain a particular orientation as illustrated by scribe line 1310. Further, maintaining this particular orientation of connection section 1300 may allow an entire string of drill pipe to maintain a selected and particular orientation. Additional methods and apparatuses for maintaining orientation of pipes are disclosed in U.S. Pat. No. 5,950,744 entitled "Method and Apparatus for Aligning Drill Pipe and Tubing," incorporated herein by reference.

Figure 16:
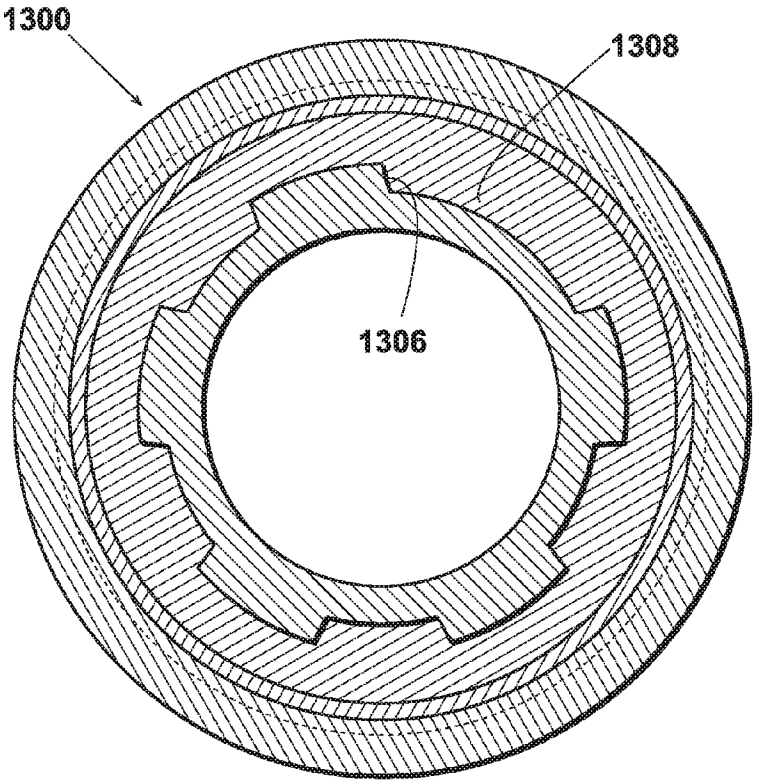
FIG. 16 is a cross-sectional view of FIG. 15.

With reference now to FIG. 16, an illustration of a center view of a connection section having a particular orientation is depicted in accordance with an illustrative embodiment. In this depicted example, connection section 1300 is seen at a fully engaged stage. As illustrated, spline 1308 fits within and is received by recessed area 1306. Spline 1308 is larger than other splines and, thus, a particular orientation may be selected and maintained.

Figure 17:
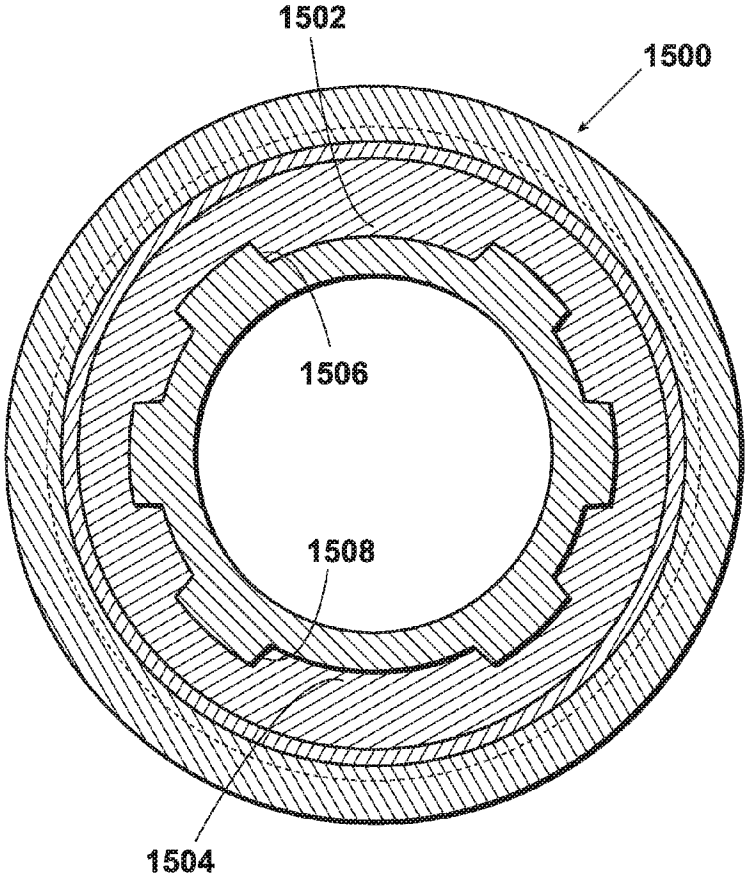
FIG. 17 is a cross-sectional view of FIG. 15 showing an alternative embodiment.

With reference now to FIG. 17, an illustration of a center view of a connection section having two particular orientations is depicted in accordance with an illustrative embodiment. In this depicted example, connection section 1500 is similar to connection section 1300 in FIG. 15. However, spline 1502 and spline 1504 are similar in size. Spline 1502 and spline 1504 may be received by either of recessed area 1506 or recessed area 1508. Thus, two particular orientations of connection section 1500 may be selected and maintained. In other embodiments, any number of orientations may be achieved.

Figure 18:
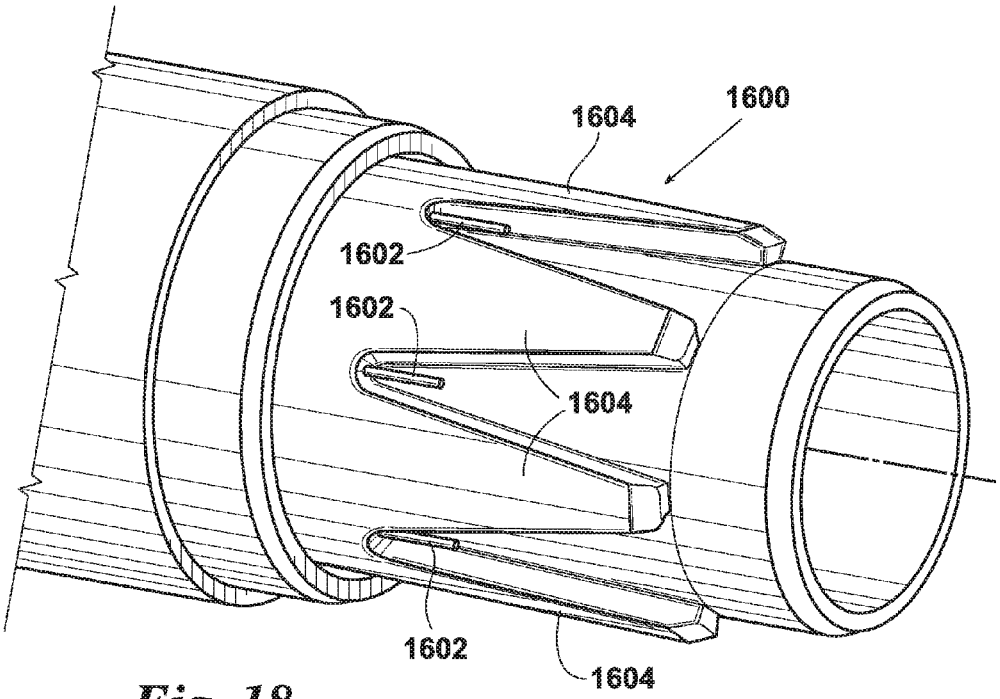
FIG. 18 is an illustration of a male joint section having wiring in accordance with an illustrative embodiment.

With reference now to FIG. 18, an illustration of a male joint section having wiring is depicted in accordance with an illustrative embodiment. In this illustrative example, male joint section 1600 includes electrical wires 1602 and plurality of splines 1604. Male joint section 1600 may be an example of one embodiment of first joint section 302 in FIG. 6 including electrical wiring. As depicted, electrical wires 1602 are positioned between bases of adjacent splines in plurality of splines 1604.

Figure 19:
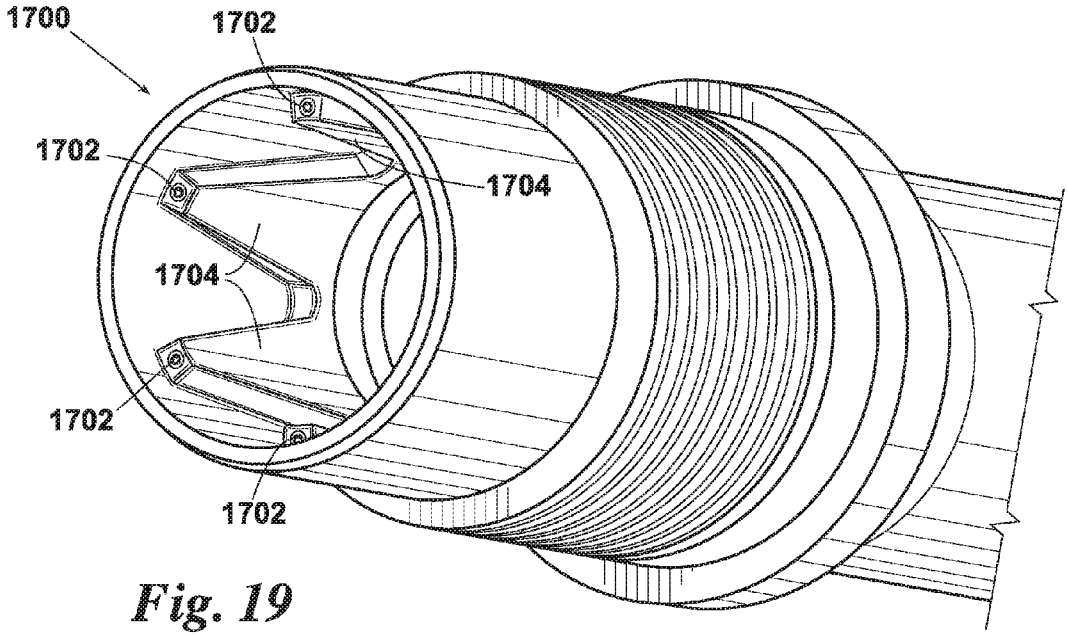
FIG. 19 is an illustration of a female joint section having wiring in accordance with an illustrative embodiment.

With reference now to FIG. 19, an illustration of a female joint section having wiring is depicted in accordance with an illustrative embodiment. In this illustrative example, female joint section 1700 includes electrical contacts 1702 and plurality of splines 1704. Female joint section 1700 may be an example of one embodiment of second joint section 304 in FIG. 7 including electrical contacts. As depicted, electrical contacts 1702 are positioned at the tips of splines in plurality of splines 1704. Female joint section 1700 may be joined with a male joint section, such as male joint section 1600 in FIG. 18, such as described in FIGS. 9-11 above, for example. In this embodiment, electrical contacts 1702 are configured to receive electrical wires, such as electrical wires 1602 in FIG. 18, as female joint section 1700 is joined with male joint section 1600 in FIG. 18. Thus, electrical wiring may be maintained through a connection of two pipes and/or as entire string of connected pipes. Additional methods and systems for including wiring in pipes are disclosed in U.S. Pat. No. 7,226,090 B2 entitled "Rod and Tubing Joint of Multiple Orientations Containing Electrical Wiring," incorporated herein by reference.

The illustrations of electrical wiring and electrical connections FIGS. 18-19 are not meant to imply physical or architectural limitations to the manner in which different illustrative embodiments may be implemented. Other components in addition to, and/or in place of, the ones illustrated may be used. Some components may be unnecessary in some illustrative embodiments. For example, in different illustrative embodiments any number of electrical wiring and electrical contacts may be used. Electrical wiring and/or electrical contacts may be inserted into any different configuration of male and/or female splines. Additionally, electrical wiring and contacts may be inserted into the walls of the pipes themselves.

Figure 20:
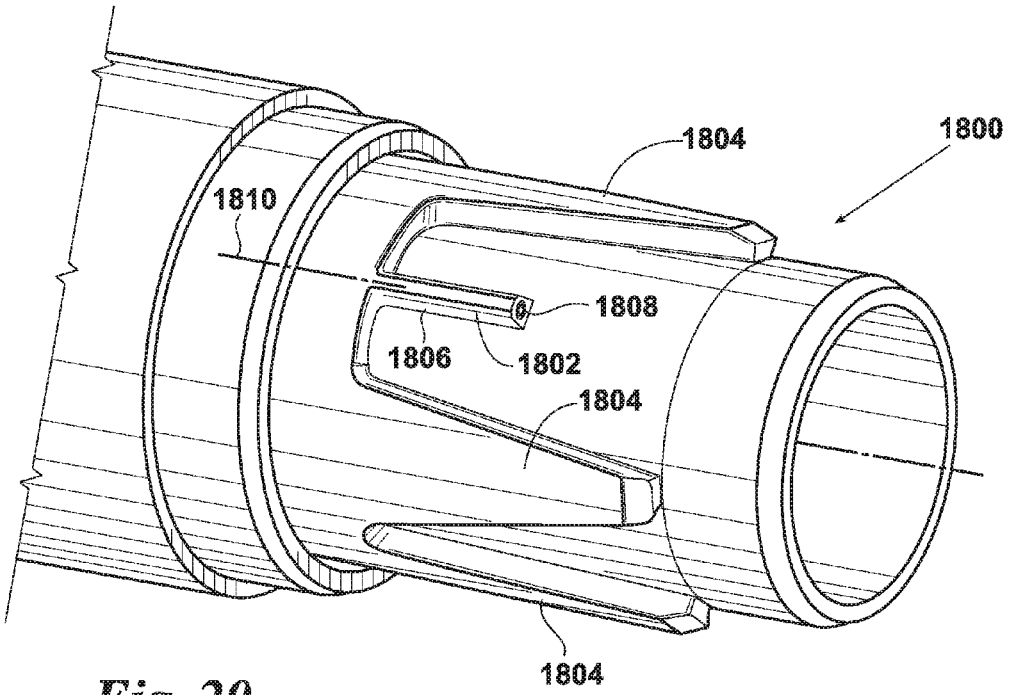
FIG. 20 is an illustration of a male joint section having wiring in accordance with an illustrative embodiment.

With reference now to FIG. 20, an illustration of a male joint section having wiring is depicted in accordance with an illustrative embodiment. In this illustrative example, male joint section 1800 includes spline 1802 and plurality of tapered splines 1804. Male joint section 1800 may be another example of an embodiment of first joint section 302 in FIG. 6 including a spline for electrical connections. Spline 1802 has flanks 1806 that are substantially parallel. Spline 1802 further includes electrical contact 1808 located at the tip of spline 1802. In this example, spline 1802 and electrical contact are substantially centered on scribe line 1810. Scribe line 1810 may be used to maintain a particular orientation for pipe connections such as described with respect to FIGS. 14-17 above, for example.

Figure 21:
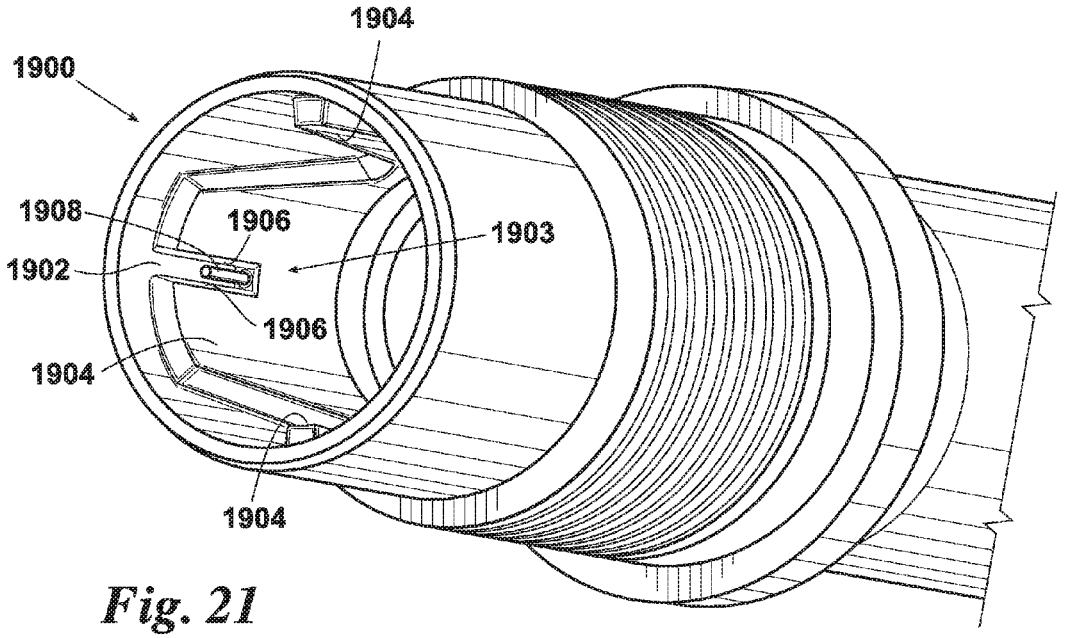
FIG. 21 is an illustration of a female joint section having wiring in accordance with an illustrative embodiment.

With reference now to FIG. 21, an illustration of a female joint section having wiring is depicted in accordance with an illustrative embodiment. In this illustrative example, female joint section 1900 includes recessed area 1902, located inside of orientation spline 1903, and plurality of tapered splines 1904, which includes orientation spline 1903. Female joint section 1900 may be another example of an embodiment of second joint section 304 in FIG. 7 including a recessed area for electrical connections. Recessed area 1902 has sides 1906 that are substantially parallel. Recessed area 1902 further includes electrical wire 1908 extending from the base of recessed area 1902.

Female joint section 1900 may be joined with a male joint section, such as male joint section 1800 in FIG. 20. These sections may be joined as described in FIGS. 9-11 above, for example. Recessed area 1902 is adapted to receive spline 1802 in FIG. 20 as female joint section 1900 is joined with male joint section 1800 in FIG. 20. A substantially parallel configuration of recessed area 1902 and spline 1802 in FIG. 20 allows for electrical wire 1908 to be guided into electrical contacts 1808 in FIG. 20. Guiding of electrical wire 1908 by the substantially parallel configuration may allow for a connection between electrical contacts 1808 in FIG. 20 and 1908 without a need to manually align electrical connectors 1808 in FIG. 20 and 1908 themselves as male joint section 1800 in FIG. 20 and female joint section 1900 are joined together.

While spline 1802 in FIG. 20 and recessed area 1902 may aid in the connection of electrical wiring, spline 1802 in FIG. 20 may not be tapered similar to plurality of tapered splines 1804 in FIG. 20. Thus, spline 1802 in FIG. 20 and recessed area 1902 may not provide the same advantages of torque transmission described above with respect to FIG. 13. However, positioning recessed area 1902 inside orientation spline 1903 reduces any negative impact using non-tapered splines for electrical connections may have.

The illustrations of electrical connections and splines having substantially parallel sides in FIGS. 20-21 are not meant to imply physical or architectural limitations to the manner in which different illustrative embodiments may be implemented. Other components in addition to, and/or in place of, the ones illustrated may be used. Some components may be unnecessary in some illustrative embodiments. For example, in different illustrative embodiments any number of electrical wiring and electrical contacts may be used. Electrical wiring and/or electrical contacts may be inserted into any different configuration of male and/or female splines. Additionally, any number of splines having substantially parallel flanks may be located in or between any number of different splines.

The description of the different embodiments of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention the practical application to enable others of ordinary skill in the art to understand the invention for various embodiments with various modifications as are suited to the particular use contemplated.

What is claimed is:

1. A system, comprising:

a first joint section having a first number of splines located near a first end of the first joint section, the first number of splines disposed on a circumferential outer surface of the first joint section, and extending in a first axial direction towards the first end and outwardly in a first radial direction from the circumferential outer surface, each of the first number of splines having a base, a tip, and a pair of flanks extending from the base to the tip wherein the pair of flanks forms an acute angle, wherein the first number of splines have first root radii at first interfaces between the first number of splines and the circumferential outer surface;

a second joint section having a second number of splines located near a second end of the second joint section, the second number of splines disposed on a circumferential inner surface of the second joint section and extending in a second axial direction towards the second end and inwardly in a second radial direction from the circumferential inner surface, each of the second number of splines having a base, a tip, and a pair of flanks extending from the base to the tip wherein the pair of flanks forms an acute angle, wherein the second number of splines have second root radii at second interfaces between the second number of splines and the circumferential outer surface;

wherein each of the first number of splines is configured to be received between adjacent pairs of splines in the second number of splines as the first end of the first joint section and the second end of the second joint section are joined to form a connection between the first joint section and the second joint section, wherein a gap is present between the tips of each of the first number of splines and corresponding portions of the flanks of the second number of splines when the first joint section and the second joint section are fully connected;

a first length of pipe interconnected to the first joint section;

a second length of pipe interconnected to the second joint section;

wherein the first joint section, the first length of pipe, second length of pipe, and the second joint section are made of aluminum or an aluminum alloy;

a load ring engaged to threads on the first joint section and spaced from the first end;

a coupling operatively interconnected to the first length of pipe and configured to engage the load ring, the coupling having internally-disposed threads that selectively engage corresponding threads on the second joint section; and wherein the load ring and coupling are made of steel or a steel alloy.

2. The system of claim 1, wherein the pairs of flanks of each of the first number of splines are wedged between and seated on flanks of adjacent splines of the second number of splines as the first end of the first joint section and the second end of the second joint section are joined and wherein the coupling is tightened to wedge the first number of splines between adjacent pairs of splines in the second number of splines to a predefined force.

3. The system of claim 1, wherein each of the first number of splines and each of the second number of splines are sized such that the first joint section and the second joint section may be connected in a number of different orientations.

4. The system of claim 1, wherein the first length of pipe is a rod, a drill pipe, a casing, a tubing, or a liner, and wherein the second length of pipe is a rod, a drill pipe, a casing, a tubing, and a liner.

5. The system of claim 1, wherein the first joint section includes a seal that engages the second joint section.

6. The system of claim 1, further comprising a filler positioned within the gaps.

7. The system of claim 1, wherein the gaps have a length from about 3/32 in. to about 9/32 in.

8. The system of claim 1, further comprising:

a first number of electrical connectors positioned between bases of splines of the first number of splines; and a second number of electrical connectors positioned on tips of splines of the second number of splines, wherein the second number of electrical connectors are configured to connect to the first number of electrical connectors when the first joint section and the second joint section are joined.

9. The system of claim 1, wherein the first joint section includes at least one electrical wire and the second joint section includes at least one electrical contact that are adapted to receive the at least one electrical wire.

10. The system of claim 1, wherein one spline of the first number of splines is a different size than the other splines of the first number of splines;

wherein the second number of splines define a plurality of recessed areas; and wherein one recessed area of the plurality of recessed areas is a different size than the other recesses of the plurality of splines and is configured to accommodate the spline of a different size when the first joint section and the second joint section are interconnected.

11. An apparatus comprising:

a first drill pipe segment having a first end comprising a first joint section and a second end comprising a second joint segment;

a second drill pipe segment having a third end comprising a third joint section and a fourth end comprising a fourth joint segment;

a first number of splines located near a first end of a first joint section, the first number of splines disposed on a circumferential outer surface of the first joint section, and extending in a first axial direction towards the first end and outwardly in a first radial direction from the circumferential outer surface, each of the first number of splines having a base, a tip, and a pair of flanks extending from the base to the tip wherein the pair of flanks forms an acute angle, wherein the first number of splines have first root radii at first interfaces between the first number of splines and the circumferential outer surface;

a second number of splines located near a second end of a second joint section, the second number of splines disposed on a circumferential inner surface of the second joint section and extending in a second axial direction towards the second end and inwardly in a second radial direction from the circumferential inner surface, each of the second number of splines having a base, a tip, and a pair of flanks extending from the base to the tip wherein the pair of flanks forms an acute angle, wherein the second number of splines have second root radii at second interfaces between the second number of splines and the circumferential outer surface;

a third number of splines located near a third end of a third joint section, the third number of splines disposed on a circumferential outer surface of the third joint section, and extending in a third axial direction towards the third end and outwardly in a third radial direction from the circumferential outer surface, each of the third number of splines having a base, a tip, and a pair of flanks extending from the base to the tip wherein the pair of flanks forms an acute angle, wherein the third number of splines have third root radii at third interfaces between the third number of splines and the circumferential outer surface;

a fourth number of splines located near a fourth end of a fourth joint section, the fourth number of splines disposed on a circumferential inner surface of the fourth joint section and extending in a fourth axial direction towards the fourth end and inwardly in a fourth radial direction from the circumferential inner surface, each of the fourth number of splines having a base, a tip, and a pair of flanks extending from the base to the tip wherein the pair of flanks forms an acute angle, wherein the fourth number of splines have fourth root radii at fourth interfaces between the fourth number of splines and the circumferential outer surface;

wherein each of the first number of splines is configured to be received between adjacent pairs of splines in the fourth number of splines of the first joint section and fourth joint section are joined to form a connection between the first drill pipe segment and the second drill pipe segment, wherein a gap remains between each tip of each of the first number of splines and corresponding portions of the flanks of the fourth number of splines when the first joint section and the second joint section are fully connected;

a first length of pipe between the first joint section and the second joint section;

a second length of pipe between the third joint section and the fourth joint section;

wherein the first joint section, the second joint section, the third joint section, and the fourth joint section, the first length of pipe, and the second length of pipe are made of aluminum or an aluminum alloy;

a load ring threadingly engaged to threads spaced from the first end;

a coupling operatively interconnected to the first length of pipe and configured to engage the load ring, the coupling also configured to interconnect to the second length of pipe; and wherein the load ring and coupling are made of steel or a steel alloy.

12. The apparatus of claim 11, wherein the pairs of flanks of each of the first number of splines are wedged between and seated on flanks of adjacent splines of the fourth number of splines as the first end of the first joint section and the fourth end of the fourth joint section are joined, and wherein the coupling is tightened to wedge the first number of splines between adjacent pairs of splines in the fourth number of splines to a predefined force.

13. The apparatus of claim 11, wherein each of the first number of splines and each of the fourth number of splines are sized such that the first joint section and the fourth joint section may be connected in a number of different orientations.

14. The apparatus of claim 11, further comprising a filler positioned within the gaps.

15. The apparatus of claim 11, wherein the gaps have a length from about 3/32 in. to about 9/32 in.

16. The apparatus of claim 11, further comprising:

a first number of electrical connectors positioned between bases of splines of the first number of splines; and a second number of electrical connectors positioned on tips of splines of the fourth number of splines, wherein the second number of electrical connectors are configured to connect to the first number of electrical connectors when the first joint section and the second joint section are joined.

* * * * *